US011584036B2

(12) United States Patent
Robinson et al.

(10) Patent No.: US 11,584,036 B2
(45) **Date of Patent: *Feb. 21, 2023**

(54) AXIAL ADJUSTMENT APPARATUS FOR CHIPPER DISC

(71) Applicant: CEM MACHINE, INC., Carthage, NY (US)

(72) Inventors: Mark D. Robinson, Black River, NY (US); Jason M. Flint, Watertown, NY (US); Daniel R. McBride, Carthage, NY (US)

(73) Assignee: CEM Machine, Inc., Carthage, NY (US)

( * ) Notice: Subject to any disclaimer, the term of this patent is extended or adjusted under 35 U.S.C. 154(b) by 113 days.

This patent is subject to a terminal disclaimer.

(21) Appl. No.: 17/098,353

(22) Filed: Nov. 14, 2020

(65) Prior Publication Data

US 2021/0129374 A1 May 6, 2021

Related U.S. Application Data

(63) Continuation of application No. 15/592,916, filed on May 11, 2017, now Pat. No. 10,836,070.

(60) Provisional application No. 62/334,854, filed on May 11, 2016.

(51) Int. Cl.
*B27L 11/02* (2006.01)
*B27L 11/00* (2006.01)

(52) U.S. Cl.
CPC ..... *B27L 11/005* (2013.01); *B27L 11/02* (2013.01)

(58) Field of Classification Search
CPC ..... B27L 11/00; B27L 11/005; B27L 11/02; B27L 11/08; B02C 18/00; B02C 18/06; B02C 18/08; B02C 18/083; B02C 18/18; B02C 18/182; B02C 18/24; B02C 2201/066
See application file for complete search history.

(56) References Cited

U.S. PATENT DOCUMENTS

| | | | |
|---|---|---|---|
| 5,727,611 | A | 3/1998 | Kalliokoski |
| 7,669,621 | B2 | 3/2010 | Nettles et al. |
| 7,681,819 | B2 | 3/2010 | McBride |

*Primary Examiner* — Matthew Katcoff
(74) *Attorney, Agent, or Firm* — Kenneth J. Lukacher Law Group; R. S. Rosenholm

(57) ABSTRACT

An apparatus, system and method for adjusting and setting a fixed position of an axially displaceable shaft and rotary chipper disc combination, without requiring an attachment to or obstruction of an end face of either end of the axially displaceable shaft. A rotary chipper disc recoil mechanism is also provided for the purpose of detection of unwanted axial forces placed upon the rotating shaft caused by unintentional chipping of metal, and for limiting consequential damage caused by the unintentional chipping of metal and other non-wood materials.

20 Claims, 18 Drawing Sheets

AXIAL ADJUSTMENT APPARATUS FOR CHIPPER DISC

CROSS REFERENCE TO RELATED PATENT APPLICATION(S)

This document is a continuing U.S. non-provisional utility patent application being filed under 37 CFR 1.53(b), that claims priority and benefit to, U.S. non-provisional utility patent application Ser. No. 15/592,916 which was filed on May 11, 2017, and that is entitled "AXIAL ADJUSTMENT APPARATUS FOR CHIPPER DISC", and which is also incorporated herein by reference in its entirety. The U.S. non-provisional utility patent application Ser. No. 15/592,916, claims priority and benefit to U.S. (utility) provisional patent application having Ser. No. 62/334,854, (Confirmation No. 4910), that was filed on May 11, 2016, and that is entitled "AXIAL ADJUSTMENT APPARATUS FOR CHIPPER DISC", and which is also incorporated herein by reference in its entirety. All of the above referred to documents are each incorporated herein by reference in their entirety.

PATENT APPLICATION(S) INCLUDING RELATED SUBJECT MATTER

This document is a United States non-provisional utility patent application, that includes subject matter generally related to that of U.S. Pat. No. 7,669,621 to Nettles et al., that was issued on Mar. 2, 2010 and entitled "Stationary Bedknife for Disc Chipper Apparatus", and generally related to U.S. Pat. No. 7,681,819 to McBride, that was issued on Mar. 23, 2010 and entitled "Disc Adjustment System for Chipper Apparatus". The aforementioned patents are incorporated herein by reference in their entirety.

FIELD OF THE INVENTION

An apparatus for adjusting and setting a fixed position of an axially displaceable shaft and rotary chipper disc combination.

BACKGROUND OF THE INVENTION

A wood chipping disc is a circular shaped object that includes wood chipping knives that are designed for slicing larger pieces of wood, such as wood logs, into smaller sized wood chips. The wood chipping disc is attached to a rotating shaft along an axis of rotation. Rotation of the shaft and the wood chipping disc are driven by a transmission and engine combination.

The discussion above is merely provided for general background information and is not intended to be used as an aid in determining the scope of the claimed subject matter.

BRIEF DESCRIPTION OF THE INVENTION

An apparatus, system and method for adjusting and setting a fixed position of an axially displaceable shaft and rotary chipper disc combination, without requiring an attachment to or obstruction of an end face of either end of the axially displaceable shaft. A rotary chipper disc recoil mechanism is also provided for the purpose of detection of unwanted axial forces placed upon the rotating shaft caused by unintentional chipping of metal or other non-wood materials such as stones, and for limiting consequential damage caused by the unintentional chipping of such materials.

This brief description of the invention is intended only to provide a brief overview of subject matter disclosed herein. This brief description is not intended to identify key features or essential features of the claimed subject matter, nor is it intended to be used as an aid in determining the scope of the claimed subject matter.

BRIEF DESCRIPTION OF THE DRAWINGS

So that the manner in which the features of the invention can be understood, a detailed description of the invention may be had by reference to certain embodiments, some of which are illustrated in the accompanying drawings. The drawings are not necessarily to scale, and the emphasis generally being placed upon illustrating the features of certain embodiments of the invention. In the drawings, like numerals are used to indicate like parts throughout the various views. For further understanding of the invention, reference can be made to the following detailed description, read in connection with the drawings in which.

DETAILED DESCRIPTION OF THE INVENTION

Figure 1:
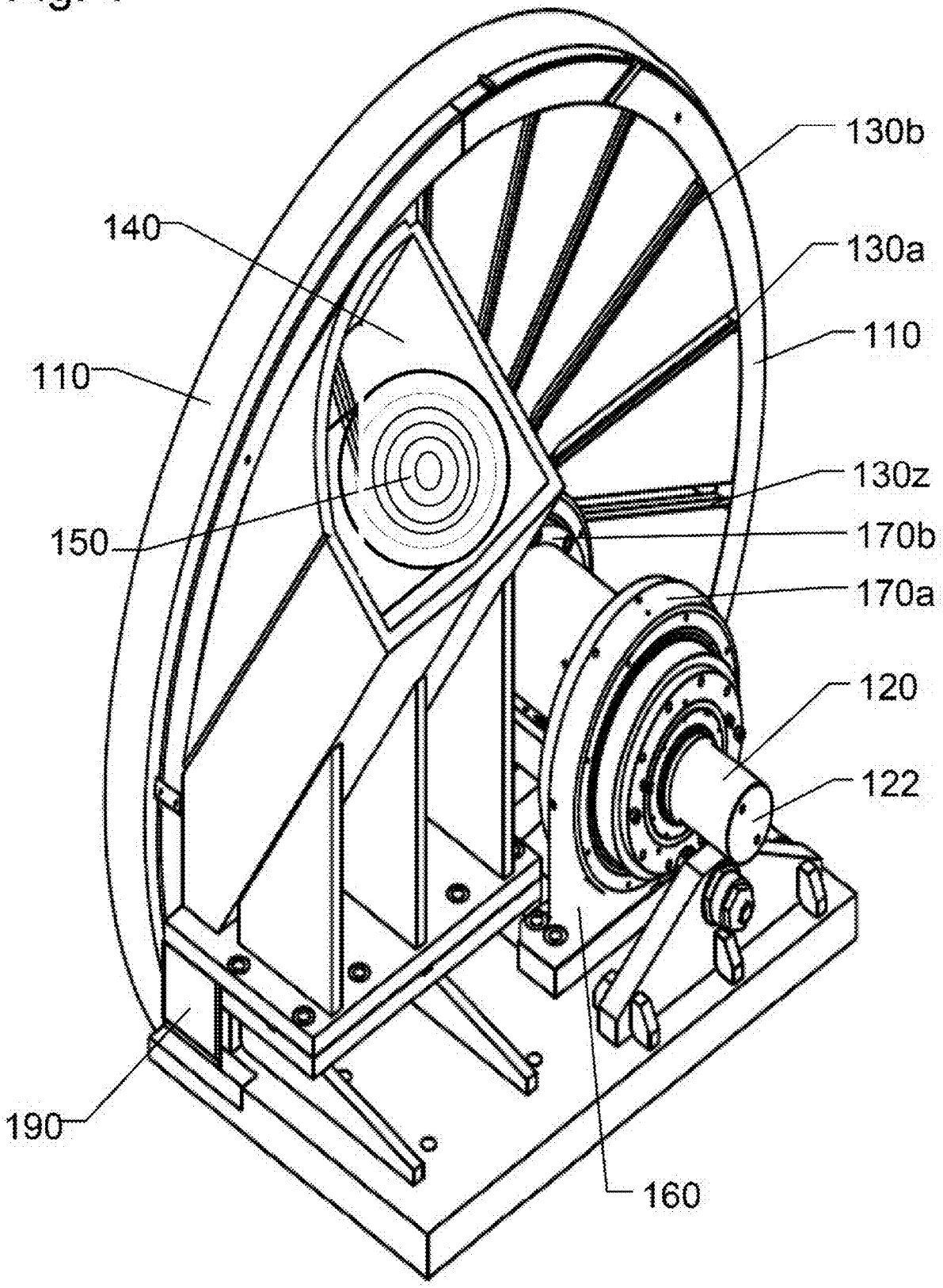
FIG. 1 illustrates a perspective view of a wood chipping system including a chipper disc, a rotating shaft and input spout for wood, referred to herein as "wood input spout".

FIG. 1 illustrates a perspective view of a wood chipping system 100 including a chipper disc 110, a rotating shaft 120 and wood input spout 140. As shown, a chipper disc 110, also referred to herein as a rotary or rotating disc 110 or disc 110, is oriented vertically while connected to and rotating with a horizontal oriented drive shaft 120 and shown while cutting through a wood log 150 that is shown as being disposed within a wood input spout 140.

A horizontal shaft orientation is shown here for convenience, and the shaft 120 shown here may be alternatively oriented at nearly any angle that is offset relative to the horizontal position (parallel to the surface of the earth) shown here, provided that the shaft 120 remains co-axial to an axis of rotation of the chipper disc 110, and where the axis of rotation of the chipper disc 110 passes in a perpendicular direction through a center location on the circular and planar shaped side of the chipper disc 110.

In this FIG. 1, the circular shaped chipper disc 110 is located to the left hand side of the shaft 120. The horizontal position of the shaft 120 is supported on a structural mount 160. The chipper disc 110 includes a plurality of nominally radial cutting knives and knife holding equipment 130*a*-130*z*, also referred to herein as rotating knives 130*a*-130*z*, which rotate with the chipper disc 110, in a counterclockwise direction, as shown here. Each of the rotating knives 130*a*-130*z* has a long dimension that may or may not technically intersect with an axis of rotation of the chipper disc 110. Hence, these rotating knives are radial in a "nominal sense", because these knives may be oriented in a direction that is approximately or near radial, instead of being exactly oriented in a radial direction.

A wood input spout 140 is shown to include a wood log 150 being cut (sliced) into wood chips (not shown) by the knives 130*a*-130*z* mounted on the chipper disc 110. The exact plurality (number) of cutting knives 130*a*-130*z* can vary according to chipper disc design and across various embodiments of the chipper disc 110.

A stationary bed knife 190 (See FIG. 2A), is located proximate at a bottom portion of the wood input spout 140 and typically within a small fraction of an inch of a rotating travel path of the knives 130*a*-130*z* of the rotating chipper disc 110.

The bed knife 190 applies a cutting force in a direction that generally opposes the cutting force applied by the cutting knives 130*a*-130*z* to cause slicing of the wood log 150 into wood chips (not shown) that pass through slots in the disc 110 where they are further processed, stored and/or moved.

Figure 6:
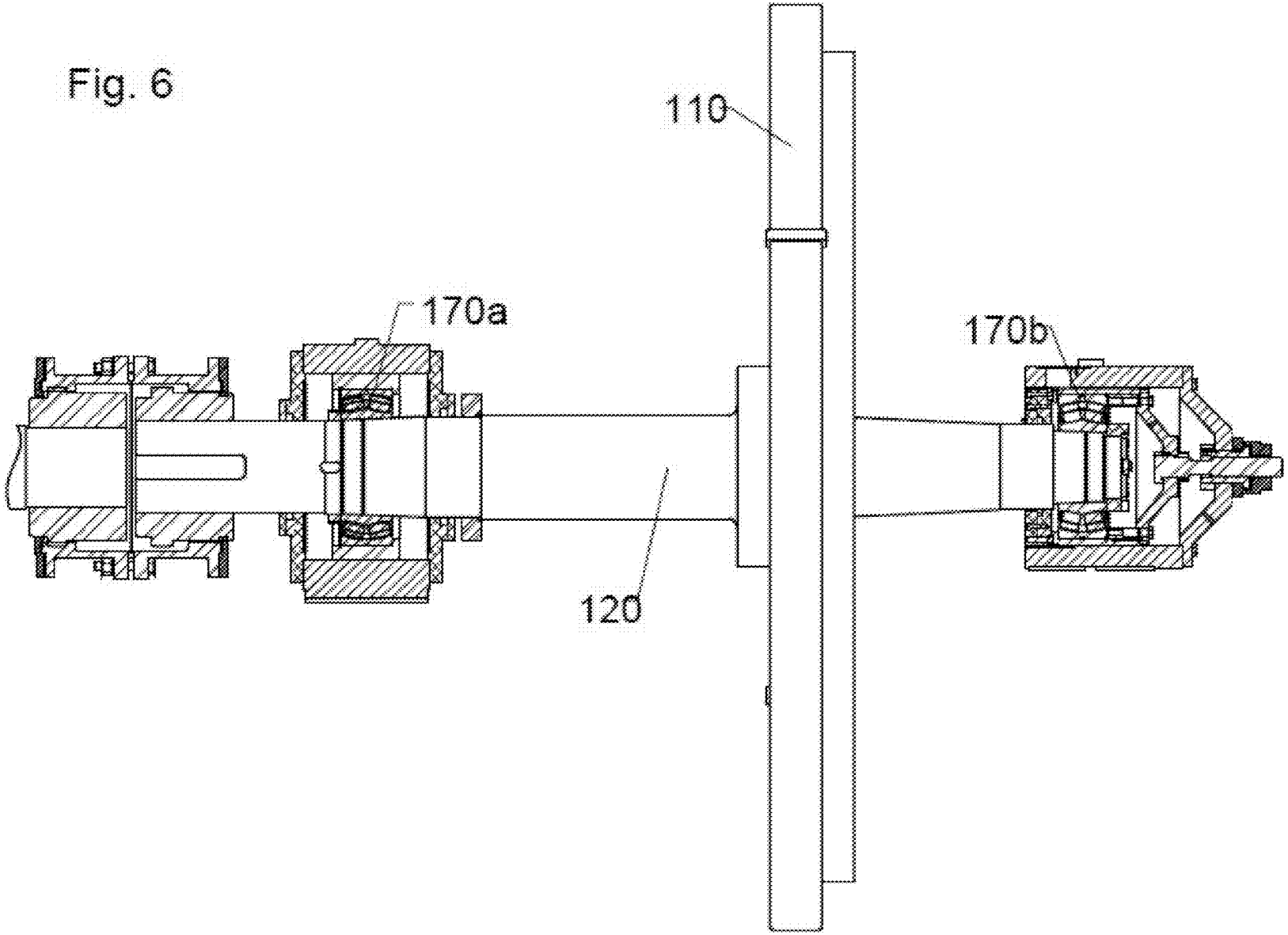
FIG. 6 illustrates a viewing perspective of a wood chipping system similar to that of FIG. 1, instead including two bearing assemblies that are each located on opposite sides of the chipper disc.

The chipper disc 110 is supported by the shaft 120 passing through it which in turn is supported by two or more bearing assemblies 170*a*-170*b*. In some embodiments, bearing assemblies 170*a* are all located on one side (as shown here in FIG. 1) while in other embodiments, such as shown in FIG. 6, bearing assemblies 170*a*-170*b* are located on both sides of the opposing flat and circular shaped sides of the chipper disc 110, by being connected to another shaft (not shown in FIG. 1), or supported by an extended segment of the shaft 120 (shown in FIG. 6), on an opposite of the side of the chipper disc 110, where the opposite side is entirely obstructed by the chipper disc itself 110, from the FIG. 1 viewing perspective, but where the opposite side of the chipper disc 110 is not entirely obstructed from the FIG. 6 viewing perspective.

Referring again to FIG. 6, there is illustrated a viewing perspective of a wood chipping system that is similar to that of FIG. 1, instead two including bearing assemblies 170*a*-170*b* that are each located on opposite sides of the chipper disc 110. In other embodiments, wood chipping systems like that shown in FIG. 1 and FIG. 6 are arranged to instead tilt the shaft 120 and the chipper disc 110 at an angle that is offset from the horizontal shaft orientation that is illustrated in both FIG. 1 and FIG. 6.

In this circumstance, an engine and transmission combination (not shown) could drive rotation of the chipper disc 110 via an attachment to an outside end 122 of the shaft 120 shown from this viewing perspective. Alternatively, as suggested in FIG. 6, an engine and transmission combination (also not shown) could be attached to drive rotation on a shaft or shaft segment attached to an opposite side of the chipper disc 110.

Figure 2A:
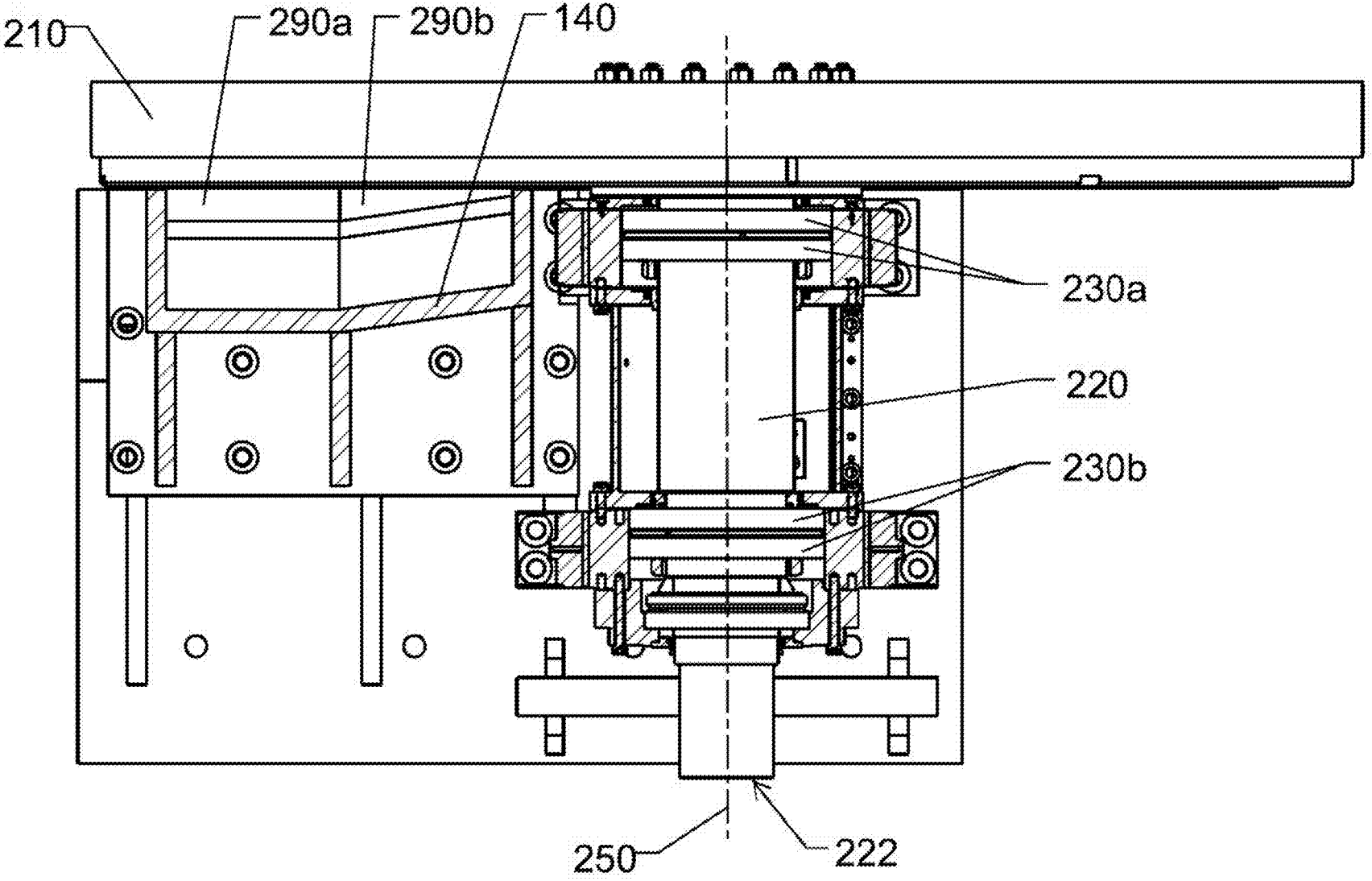
FIGS. 2A-2B are diagrams that respectively illustrate a top-down cross-sectional view and a side viewing perspective of a wood chipping system like that of FIG. 1, further indicating a location of a bed knife.

FIG. 2A is a diagram illustrating a top-down cross-sectional view of a wood chipping system 200, like that of FIG. 1, further indicating a location of a bed knife 290, which in this embodiment, is comprised of two (2) or even more separate sharp edged stationary knives 290*a* and 290*b*. This system 200 includes a rotating chipper disc 210 and a rotating shaft 220, radial roller bearing assemblies 230*a*-230*b*, and a bed knife 290 that is visible from this viewing perspective. The shaft 220 and the chipper disc 210 rotate together along an axis of rotation 250.

In this embodiment, like FIG. 1, the chipper disc 210 is connected to a front end of a shaft 220 on one side of the chipper disc 210 only. The rear end 222 portion of the shaft 220 is shown as being arranged to be attached to a transmission and/or engine including in some embodiments, the possibly mounting of a sheave (pulley), (not shown here) to turn the shaft 220. Unlike FIG. 1, a bed knife 290, that is divided into two portions 290*a*-290*b*, is visible and not obscured by the wood input spout 140 from this viewing perspective.

However, many chipping apparatus embodiments require transmission and/or engine attachment and/or obstruction to the end face of the end of the shaft 122, 222. This type of design having only one available shaft end 122, 222 and where all bearing assemblies 170 are located on the same side of the chipper disc 110, this type of design is referred to as a cantilevered chipper disc design.

As shown, a rolling element bearing assembly 230*a* provides radial support to a front portion of the shaft 220 that is closest to the chipper disc 210, while the rolling element bearing assembly 230*b* provides radial support to a rear portion of the shaft 220 that is located father away from the chipping disc 210. In this embodiment, at least one of these rolling element bearing assemblies 230*a* or 230*b* is also configured to supply some axial thrust support to the shaft 220 of this rotating chipper disc assembly.

Figure 2B:
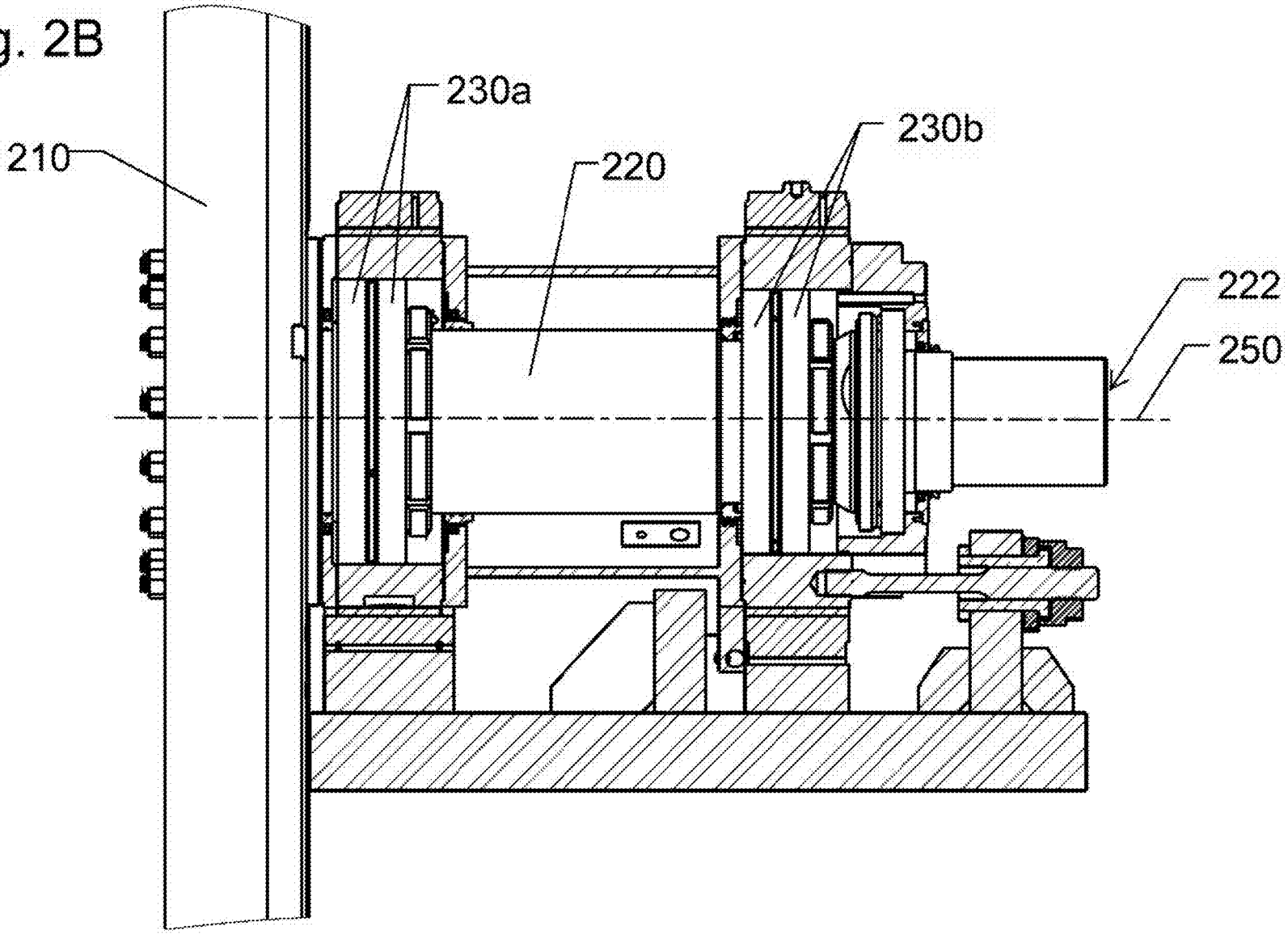

FIG. 2B is a diagram illustrating a side viewing perspective of the wood chipping system 200 of FIG. 2A. In this view, the wood input spout 140 is not visible so as to not obstruct the view of the radial roller bearing assembly 230*a*. From this viewing perspective, the bed knife 290 (290*a* and 290*b*) is also not visible. However, both of the roller bearing assemblies 230*a*-230*b* remain visible.

As shown in both FIGS. 2A-2B, the rolling element bearing assemblies 230*a*-230*b* surround the shaft 220 like two donut shaped devices 230*a*-230*b*. As shown, the shaft 220 is disposed through each respective hole of each donut shaped rolling element bearing assembly 230*a*-230*b*.

Figure 3A:
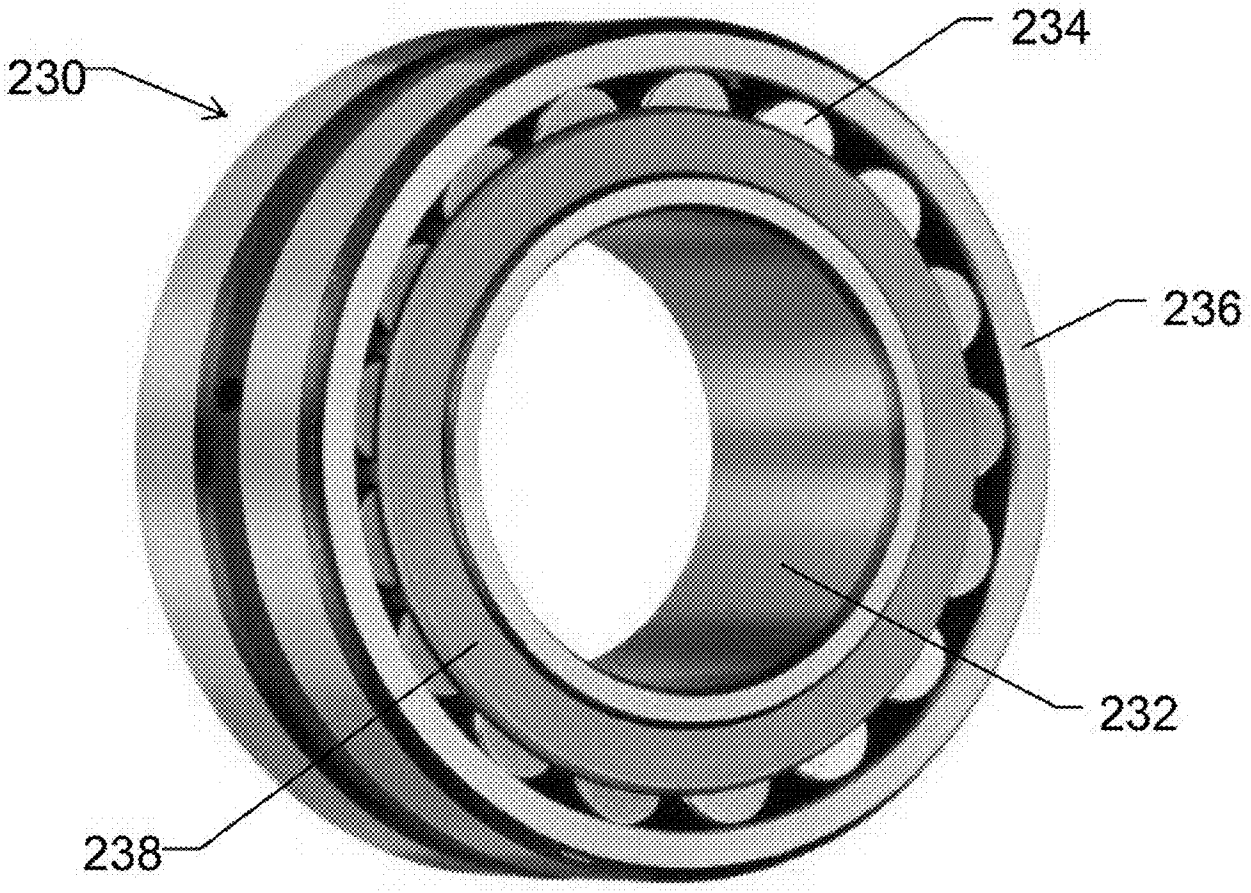
FIGS. 3A-3B are diagrams that each illustrate a side view of an embodiment of a typical rolling element bearing assembly, like the rolling element bearing assemblies in FIGS. 2A-2B.
Figure 3B:
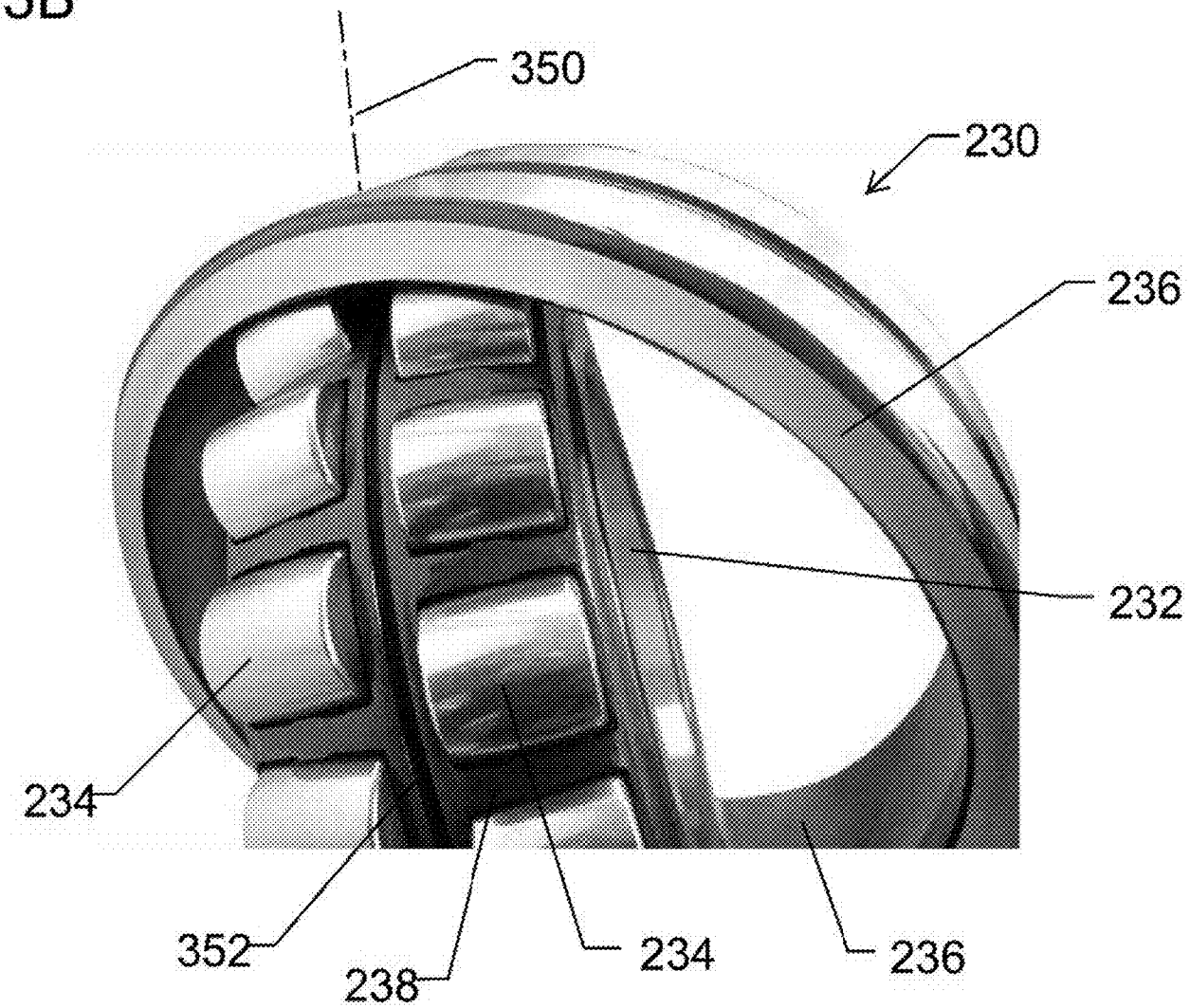

FIGS. 3A-3B are diagrams that each illustrate a side view of one embodiment of a typical spherical roller bearing assembly 230, like the roller bearing assemblies 230*a*-230*b* shown in FIGS. 2A-2B. Alternatively rolling element bearings of many other types, other than shown here, such as, cylindrical, tapered, ball, needle bearings can also be employed for a same or similar purpose as the roller bearing assembly 230 employed herein, for example. As shown, a roller bearing assembly 230 has a donut-like shape.

Referring to FIG. 3A, a plurality of bearing rollers 234 are sandwiched between a first circular shaped surface, called an inner race 232 and a second circular shaped surface called an outer race 236. The inner race 232 defines an inner perimeter and the outer race 236 defines an outer perimeter of the donut like shape of the roller bearing assembly 230.

Although the bearing rollers 234 may appear to be of a cylindrical shape, these bearing rollers 234 instead have a slightly barrel shape. The outer race 236 has an interior (inner) surface (See FIG. 3B) that is slightly concave to better fit the slight barrel shape of the bearing rollers 234.

Figure 4A:
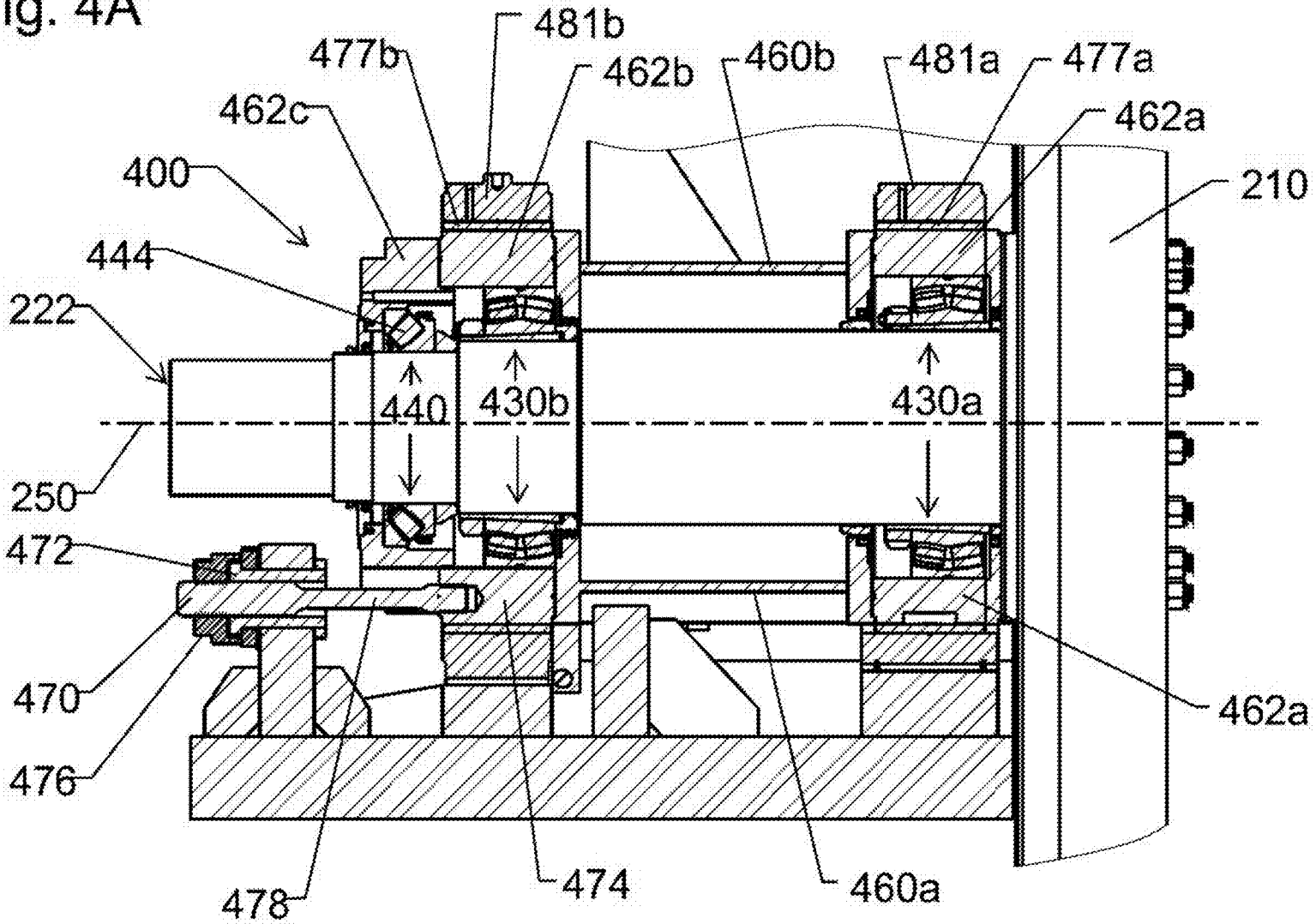
FIGS. 4A-4C are diagrams illustrating a cross-sectional and opposite side view of the wood chipping system of FIGS. 2A-2B, in combination with an axial adjustment mechanism for the rotating chipper disc and shaft, in accordance with the invention.
Figure 4B:
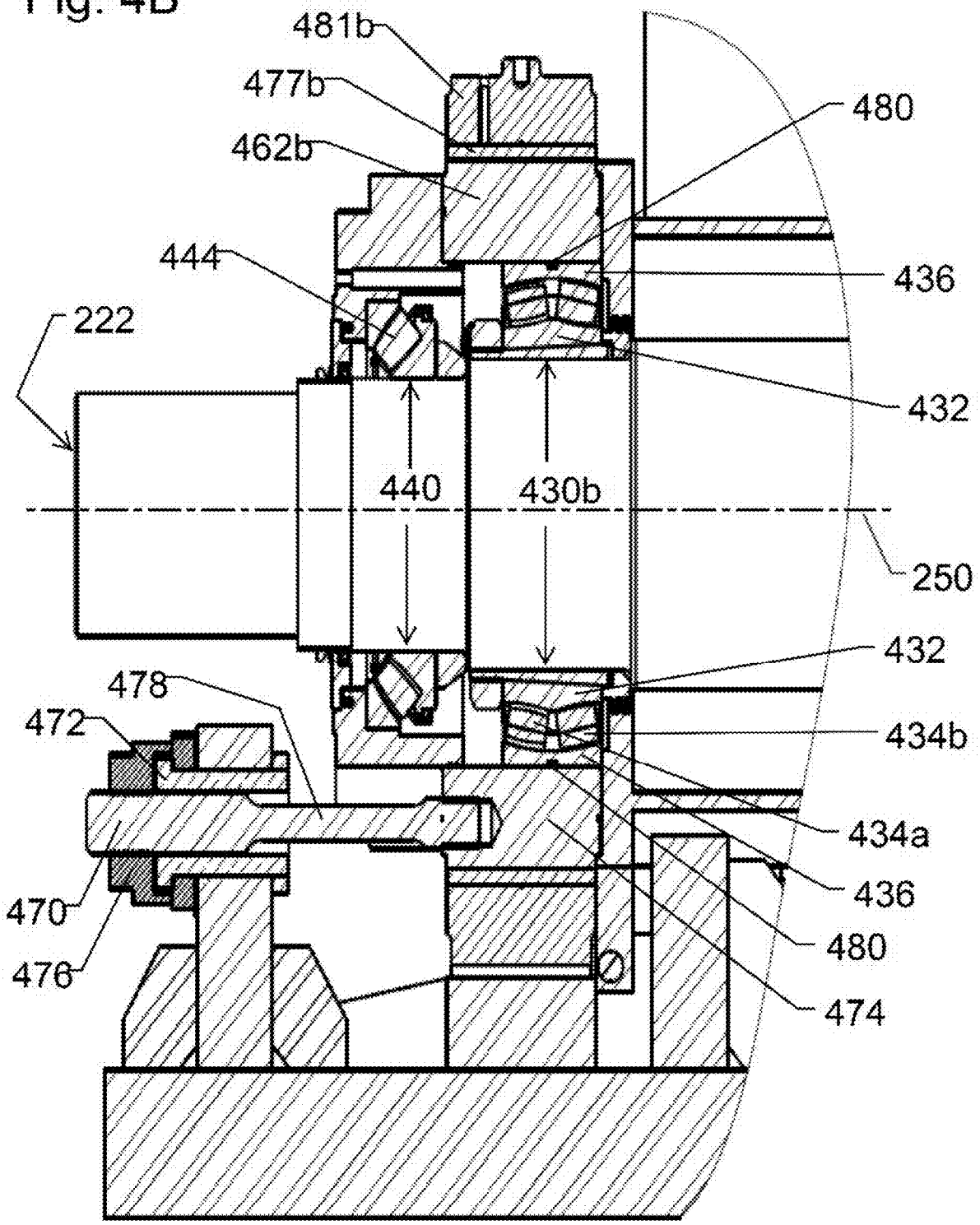

In a another preferred embodiment of a spherical roller bearing (See FIG. 4B), the outer race 436 of FIG. 4B has an inner surface that is not entirely planar and instead, this inner surface is slightly curved and concave in shape so that the rollers 434*a*-434*b*, also being of a slightly barrel shape, can better rotate and run along this outer curved (not entirely planar) surface 436. This type of embodiment is also referred to as a spherical roller bearing.

A bearing roller 234 retention mechanism 238, which has an appearance of an outer wall 238, is designed to retain each of the positions of the plurality of bearing rollers 234 in relation to the inner race 232. Another retention mechanism (See FIG. 3B), is employed to allow the position of the inner race 232 and its associated bearings 234 to turn and pivot, but remain at least partially retained inside of the outer race 236. In normal operation, the positions of the plurality of bearing rollers 234 are each retained (sandwiched) in between the inner race 232 and the outer race 236.

Referring to FIG. 3B, it is shown that the inner race 232 and the roller bearings 234 disposed are positioned in two rows, and can appear from some viewing perspectives like a formation of adjacent pairs of bearing rollers 234, along the outer surface of the inner race 232. The inner race 232 and its two rows of bearing rollers 234, can collectively turn and pivot (swivel) around a retaining spindle (not shown) along a retaining axis 350 and turn away from being positioned entirely inside of the outer race 236. When pivoted, the position of the inner race 232 remains at least partially retained inside of the outer race 236.

When employing this type of roller bearing assembly 230, the shaft 220 is disposed inside and adjacent to an inner surface of the inner race 232 and the inner race 232 is attached to and rotates with the shaft 220. The swivel feature of the inner race 232 that is described above enables the roller bearing assembly 230 to more flexibly provide radial support in response to bending of the shaft 220 while it is rotating.

Note that the outer race 236 has an interior (inner) surface that is slightly concave and centered along a center line 352 of the bearing retention mechanism 238 when the inner race 232 is entirely positioned inside of the outer race 236.

FIG. 4A is a diagram illustrating a wood chipping system 400, which is a cross-sectional and opposite side view of the wood chipping system 200 of FIGS. 2A-2B, in combination with an axial adjustment mechanism for the rotating chipper disc 210 and shaft 220, in accordance with the invention. This system is more likely to be employed when the chipper shaft is not mounted horizontally, creating a circumstance having even more motivation for employing a bearing assembly having greater axial thrust resistance and axial position support capabilities.

Unlike FIGS. 1 and 2B, the chipper disc 210 is shown here on a right hand side of this viewing perspective. In this illustration, the shaft 220, the chipper disc 210 and (2) radial roller bearing assemblies 430*a*-430*b*, are both shown here from a cross-sectional viewing perspective. Each roller bearing assembly 430*a*-430*b* is donut shaped and designed much like the roller bearing assemblies of FIGS. 3A-3B.

In this embodiment, as described for FIGS. 3A-3B, each radial bearing assembly 430*a*-430*b* has a circular (donut) shape that surrounds an outer circumference of the shaft 220, each at a location within a middle portion of the shaft. The middle portion of the shaft 220 being located between and away from opposite end portions of the shaft 220. An end portion of the shaft including an end surface, also referred to as an end face (See 122, FIG. 1, (See 222, FIGS. 2A-2B, 4A-4C and 5A-5C) which is a surface that faces parallel to circular profile of the chipper disc 110, 210 and perpendicular to the axis of rotation 250.

As shown in FIGS. 3A-3B, a plurality of roller bearings are placed around a circumference of the shaft 220 adjacent to an inner race 232. These pairs of roller bearings are enclosed inside of a pair of curved surfaces (See 432, 436 of FIG. 4B), like the inner race 232 and outer race 236 of FIGS. 3A-3B, that surround the outer circumference of the shaft 220 and that hold the roller bearings 234 in place to provide at least radial support to the shaft 220.

Additionally, there is an additional axial thrust bearing assembly 440, which provides primarily unidirectional, but in some embodiments can be designed to also supply bidirectional axial thrust support to the shaft 220 and chipper disc 210, and that is generally directed at about 45 degrees away from the axis of rotation 250 of the shaft 220. In this way the axial thrust loading requirements on bearing assemblies 230*a* and/or 230*b* are greatly reduced.

In this embodiment, the chipper disc 210 is said to be cantilevered, given that the chipper disc 210 is supported on only one, and not both of its circular sides by a shaft or shaft segment. The radial bearings 430*a* and 430*b* also provide support from gravity to the shaft 220 as it is disposed in a horizontal orientation as shown.

An advantage of a cantilevered chipper disc arrangement, is that a volume of space required to accommodate a chipper disc 210 and a shaft 220 can be reduced relative to a non-cantilevered arrangement. However, with this cantilevered arrangement, there is only one exposed end and end face 222 of a shaft 220 which is available for attachment to an engine and/or transmission to be employed for rotating the shaft 220.

The stationary bed knife 290, that is not shown from this viewing perspective, is located on an opposite side of the shaft 220, as shown in FIG. 2A. A distance between the rotating chipper disc 220 and the stationary bed knife 290 is carefully selected and maintained to produce wood chips of a desired dimension. Such a distance is set via control of an axial position of the shaft 220 relative to a stationary bed knife 290. This distance is typically set between 20-60 thousandths of an inch. In some embodiments, the position of a bed knife is adjustable, and not absolutely stationary, however, the above described mechanism can also be applied to such an adjustable bed knife.

Prior art mechanisms for controlling an axial position of the shaft 220 exist, as described in U.S. Pat. No. 7,681,819 to McBride, for example, which is also referred to herein as the '819 patent. However, as described within the '819 patent, such a mechanism requires attachment to an outer end 222 of the shaft 220, creating a conflict with regard to allocation of space with respect to an engine and/or transmission that would also require attachment to a same one outer end 222 of the cantilevered shaft 222.

In accordance with the invention, here is described an apparatus, system and method for setting and adjusting a position of an axially displaceable shaft and rotary chipper disc combination, that does not require attachment to an outer end of a shaft 220.

Referring again to FIG. 4A, the thrust bearing 440 and each largely radial bearing set 430*a*-430*b* is designed to be rotationally attached to the shaft, so that when an axial force is applied to these bearing outer races, the axial force is transferred and also applied to the shaft 220 itself. Essentially, the bearing set 440 and 430*a*-430*b* are axially attached to the shaft 220. Note that each of the bearing assemblies 430*a*-430*b* and 440 are surrounded by an outer enclosure, also referred to herein as a bearing carrier sleeve and collectively, with their associated lubrication sealing elements, as a cartridge 462*a*-462*c* respectively.

Furthermore, bearing sets 430*a* and 430*b* can be rigidly connected together via a connecting member 460*a* and 460*b* that connects the respective cartridges 462*a*-462*b* of the bearing sets 430*a*-430*b*, so that when such an axial force is applied to outer races 436*b* of bearing assembly 430*b* or to 462*c* of 440 (FIG. 4A)), it is also applied to outer race 462*a* bearing assembly 430*a*, and vice versa. The same rigid bearing assembly connection arrangement can be applied between bearing assembly 230*a* and 230*b* of FIGS. 2A-2B).

The cartridge support housing 481*a*-481*b*, is fixedly attached to and provides axial and rotational restraint to each respective cartridge 462*a*-462*b*. Each cartridge support housing 481*a*-481*b* may or may not be equipped with a slide bearing support 477*a* or 477*b* at the slide surfaces where they permit axial movement of the cartridges 462*a*-462*b*

As shown in FIG. 4A, an adjusting screw 470 is employed to apply an axially directed force to a rear carrier sleeve 474, which is attached to bearing assembly 230*b* (FIG. 2A), 440 (when used) and 430*b* (FIG. 4A). The rear carrier sleeve 474 transfers the axial directed force to bearing 430*b* (and 440, when used) and one of which transfers the axial force through bearing to the shaft 220.

The adjusting screw 470 has an outer threaded surface which is designed in the preferred embodiment to engage with a threaded surface of a largely axially stationary but rotationally free adjusting nut 472. With respect to a viewing perspective of the adjusting screw 470 from a location proximate to the end 222 of the shaft 220, and in a direction towards the chipper disc 210, turning the adjusting nut 472, being a rotating element in this embodiment, in a clockwise direction (if threaded with right hand threads) causes the adjusting screw 470 to move axially and further penetrate and move through the axially fixed adjusting nut 472 and move the chipper disc 210 in a direction towards the bed knife 290 (290*a*-290*b*), constituting a right hand side to left hand side movement of the adjusting screw 470 and chipper disc 210 with respect to the viewing perspective shown in FIG. 4A. In this preferred embodiment, the adjusting (thrust) screw 470 is axially fixed to the carrier sleeve 474.

In a less preferred embodiment, the adjusting screw 470, being a rotating element in this embodiment, can be permitted to rotate if it is also fit with gripping capability such as wrench flats, and rotates within a fixed nut 472 in which case it can only be axially (but not rotationally) attached to carrier sleeve 474. In this instance, the chipper disc 210 and adjusting screw 470 axial movement described in the preceding paragraph is opposite in response to the indicated clockwise rotation of the screw 470.

In either case above, the carrier sleeve 474 and any possible interconnecting elements 460*a* and 460*b* are designed to slide in a direction parallel to the axis of rotation 250 of the shaft 220, so that the adjusting screw 470 can push or pull the carrier sleeve 474 and thereby also the chipper disc 210 in either axial direction that is parallel to the shaft.

Specifically in the preferred embodiment the adjusting screw 470 pulls the carrier sleeve 474 (and the chipper disc 210) towards the bed knife 290 while it 470 is rotating clockwise, or pushes the carrier sleeve 474 (and the chipper disc 210) away from the bed knife while it 470 is rotating counter-clockwise, as causing axial forces to be applied to the carrier sleeve 474 results in this applying the same axial force to bearing set 440, 430*a* & 430*b* and to move the shaft 220 in the same direction accordingly. The above described shaft axial movement mechanism enables controlled axial movement of the shaft 220 and thereby also the chipper disc 210 without attaching to or obstructing the end face of the end 222 of the shaft 220.

Furthermore, once the axial position of the shaft 210 is set as described above, constituting an operational set point, it can be locked via a locking nut 476. Upon moving the shaft to a desired axial location, the locking nut 476 is rotated in a clockwise direction (tightened on right hand threads) so as to lock the position of the adjusting screw 470 and adjusting nut 472 and to lock the position of the carrier sleeve 474, the bearing sets 440, 430*a* and 430*b* (or 230*b* for FIGS. 2A-2B) and the axial position of the shaft 220 and the chipper disc 210. This is essential to prevent unwanted change in the chipper disc set point position as a result of normal chipping vibrations and forces.

FIG. 4B is a diagram illustrating an enlarged view of the shaft axial movement mechanism that is also shown in FIG. 4A. The largely radial roller bearing assembly 430*b* that is shown in FIG. 4A is also shown here in FIG. 4B. Like what is shown in FIG. 3A, the radial roller bearing assembly 430*b* that is shown here, includes an inner race 432, bearing rollers 434*a* and 434*b*, and outer race 436.

As is shown in FIG. 3A, the inner race 432 that is shown here, has an outer surface that is not entirely planar like that of the inner race 232 of FIG. 3A, and instead includes two separate surfaces that join at, and slope away from, a center location of the entire inner race 232.

The inner race 432, as described above, provides a surface that is joined at a center location, and that is a radial extension of the outer surface of the shaft 220. This radial extension is fixedly attached to and rotates with the shaft 220. The bearing rollers 434*a*-434*b*, each have a near cylindrical and barrel like shape, and each have a center axis that is proximate to (typically within 20 degrees) of being parallel with the axis of rotation 250 of the shaft 220 and of the chipper disc 210.

Each roller bearing 434*a*-434*b* has two opposing end surfaces (not shown) that are circular shaped and substantially planar and that are perpendicular to the center axis of each respective barrel shaped roller bearing 434*a*-434*b*. In response to rotation of the shaft 220, each roller bearing 434*a*-434*b* rotates around its own center (barrel) axis as well as rolling in an orbit about 250. A narrow gap exists between the roller bearings 434 and the outer race 436.

A groove 480, which appears in this cross-sectional view as a notch 480, is employed as a mechanism to lubricate the radial bearing assembly 430*b*. The outer race 436 is attached to the rear carrier sleeve 474, via a low (tight) tolerance friction fit connection as well as other mechanical means such as an externally threaded nut (not shown) when no 440 thrust bearing is used. As a result, the outer race 436 does not rotate in response to rotation of the shaft 220 or in response to rotation of the bearing rollers 434*a*-434*b*. A bearing retaining mechanism, like the bearing retaining mechanisms described in association with FIGS. 3A-3B, attaches the roller bearings 434 with respect to axially directed movement, to the outer race 436 and to the inner race 432 (FIGS. 4A-4B) and 232 (FIGS. 2A-2B). The thrust bearing 440 of FIGS. 4A-4B is similarly fixed and equipped with bearing rollers 444 that responds in the same way as bearing rollers 434*a* and 434*b*.

As a result, axial movement of the rear carrier sleeve 474, causes axial movement of the outer race 436, which causes axial movement of the bearing rollers 444, 434*a*-434*b*, which causes axial movement of the bearing retention mechanism, and which causes axial movement of the inner race 432, being a radial extension of the shaft 220, causing axial movement of the shaft 220 and of the chipper disc 210.

Note that there exists some "axial float", meaning that the shaft 220 can move axially relative to the outer race 436 by a small fraction of an inch, in some embodiments, about 10-30 thousandths of an inch. In some embodiments, the outer race 436 is a non-rotating element. Note that the outer race 436, like other non-rotating elements are not required to be loosened to permit an axial force to be applied to the shaft 220.

Figure 4C:
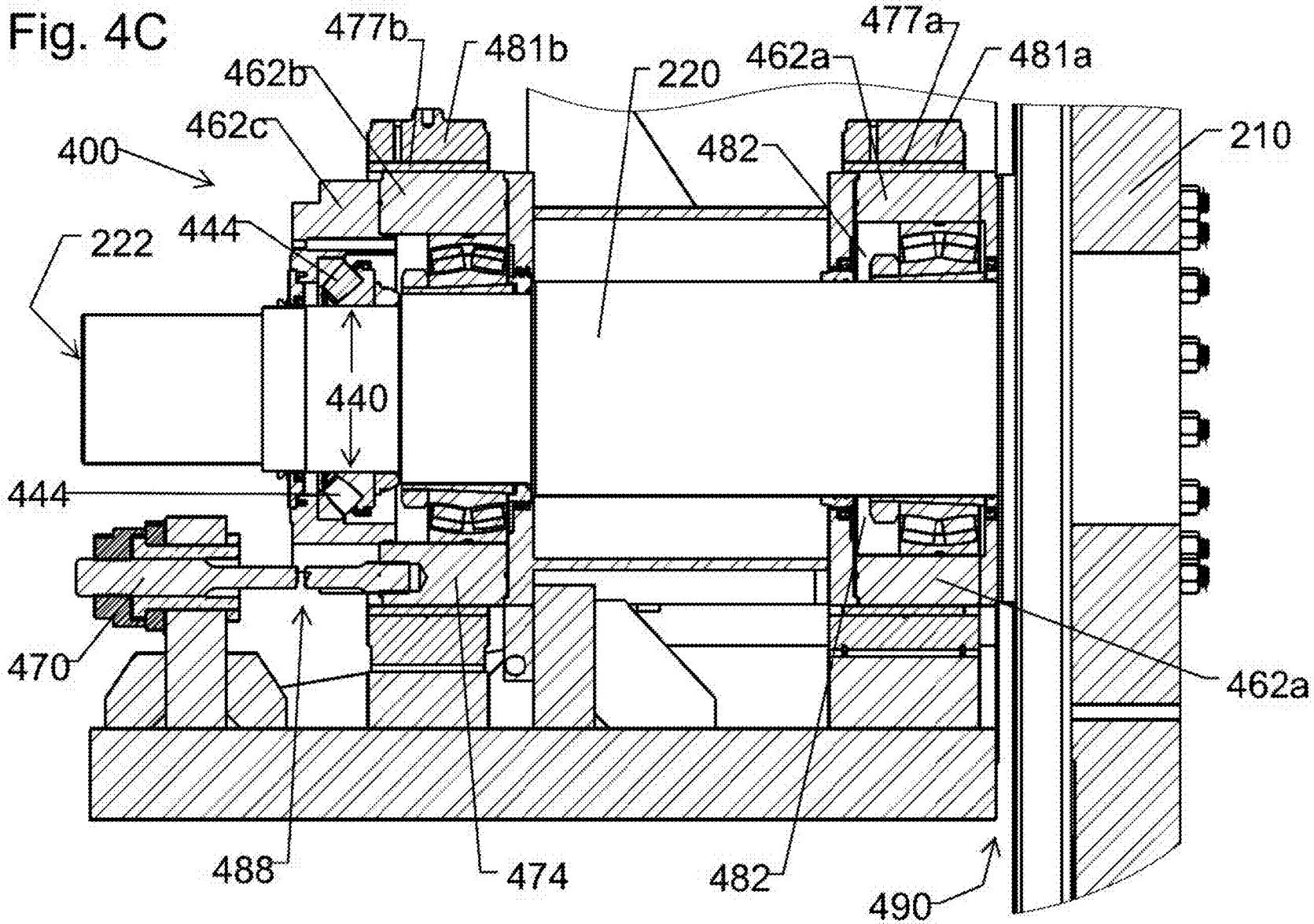

Also note that there is some limited axial clearance, also referred to herein as axial "float", between the cartridge 462*a* and its respective roller bearing assembly 430*a* and shown by an axial gap 482 (See FIG. 4C). This axial gap 482 is just a small fraction of an inch, in some embodiments, less than 100 thousandths of an inch. This roller bearing assembly 430*a* is said to be "floating" while roller bearing assembly 430*b*, which lacks such an axial gap, is said to be "held". From a practical standpoint, it is best to not have more than one bearing assembly with a fixed (held) axial position in any one direction at the same time.

Also note that the above described shaft axial movement mechanism, is designed to function when the shaft is not rotating or when the shaft is rotating and not chipping wood. While chipping wood, other axial forces are directed towards the shaft 210 which can interfere with adjustment of the axial position of the shaft 210.

FIG. 4C is a diagram illustrating the wood chipping system 400 of FIG. 4A after a chipper disc recoil action (event) has occurred.

A concern with operating a chipper disc is a possibility of pieces of metal and non-wood materials mixing in with wood to be chipped. This situation causes the chipper disc 210 to collide with and process these foreign materials and to effectively chip these foreign materials in addition to wood. This circumstance is referred to as "chipping metal". Chipping metal can cause damage to the chipping disc 210 and to the knife holding hardware and the knives 130*a-z* and/or to the bed knife 290, as well as to other elements of the machine including foundations and transmission.

Typically, the position of the knives 130*a*-130*z* on the chipper disc 210 is set to form a gap of a small fraction of an inch, specifically about 20-60 thousandths of an inch away from the bed knife. It is this gap that controls attributes and the quality of wood chips produced from cutting action between knives 130*a-z* on the chipper disc 210 and the bed knife 290.

To reduce chipping metal damage caused by this circumstance of "chipping metal", a distance between the rotating chipper disc 220 and the stationary bed knife 290 is permitted to be suddenly increased if metal should come into contact with the chipper disc 220 and/or the bed knife (not shown). Such an increased distance could be set via control of an axial position of the shaft 220 relative to a stationary bed knife 290 (See FIG. 4A) via a chipper disc recoil mechanism that causes the chipper disc 210 to recoil away from the bed knife 290, in order to prevent further chipping of metal.

In one embodiment, the adjusting screw 470 is made from a metal alloy, such from as a steel alloy and shaped to form a neck of a predetermined diameter. In some embodiments the neck is designed to have a 1.5 inch diameter. This design causes the adjusting screw 470 to break apart when approximately a 100,000 pound tensile axial force is transferred from the shaft 220 and to the adjusting screw 470, via the bearing assemblies 430*a*-430*b* and the rear carrier sleeve 474.

When the chipper disc 210 begins chipping metal, forces upon the chipper disc 210 can cause a tensile axial force exceeding 100,000 pounds, for example, which would cause the neck 478 of the adjusting screw 470 to break apart and cause the chipper disc 210 to be pushed by the resulting recoil mechanism farther away from the bed knife 290 and to the right hand side of FIGS. 4A-4C.

In some embodiments, the recoil mechanism includes one or more large springs (not shown) that applies an engagement force to a pin or bar to hold the shaft 220 and the chipper disc 210 once displaced in an axial direction and which is away from the bed knife 290.

Referring to FIG. 4C, the adjusting screw 470 is shown to be broken apart into (2) pieces at location 488 and a chipper disc recoil gap 490 of about 0.5-3 inches in size is visible between the chipper disc 210 and the bed knife 290.

Figure 5A:
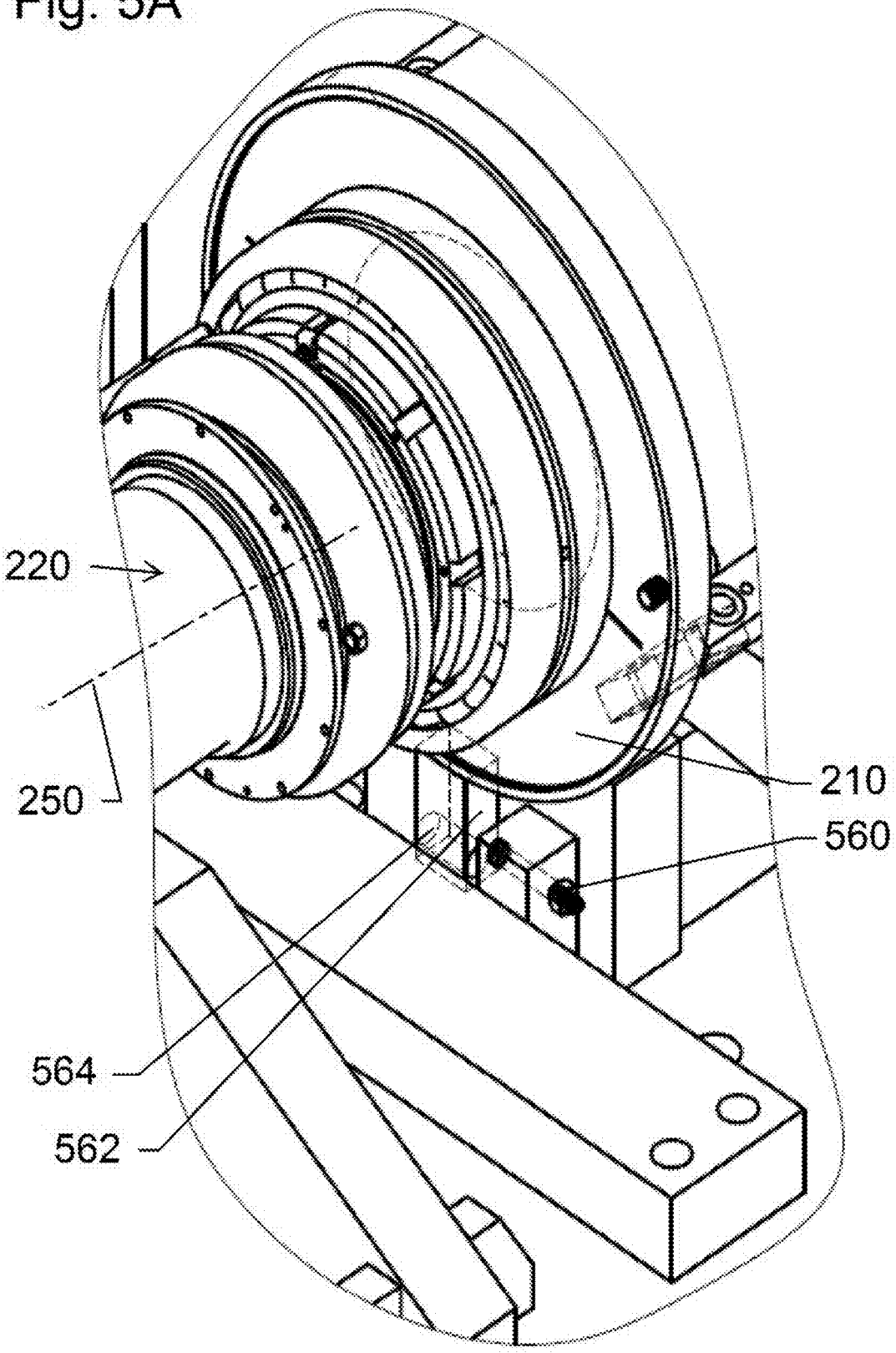
FIGS. 5A-5C are diagrams that illustrate views of a chipper disc recoil locking mechanism.
Figure 5B:
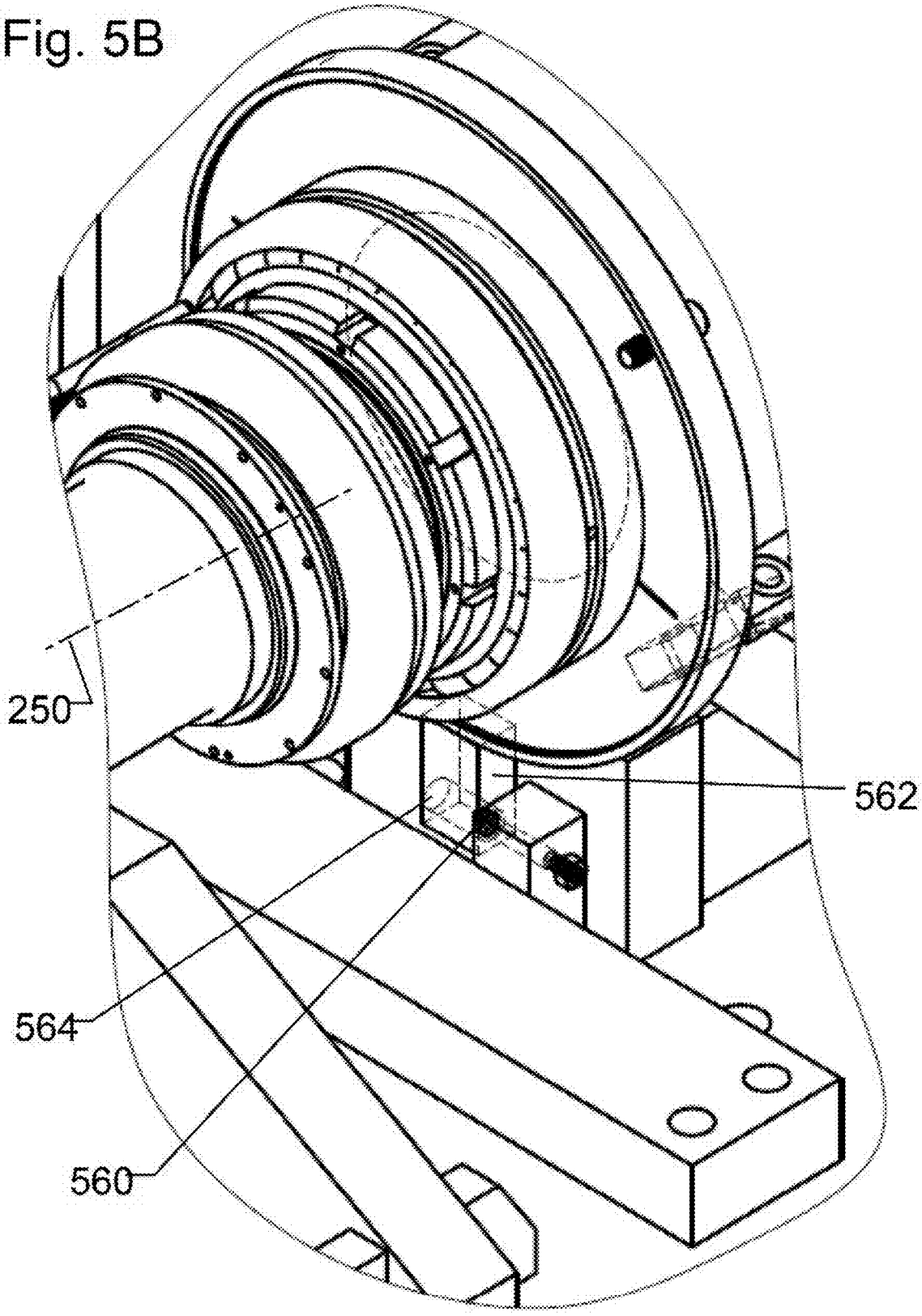
Figure 5C:
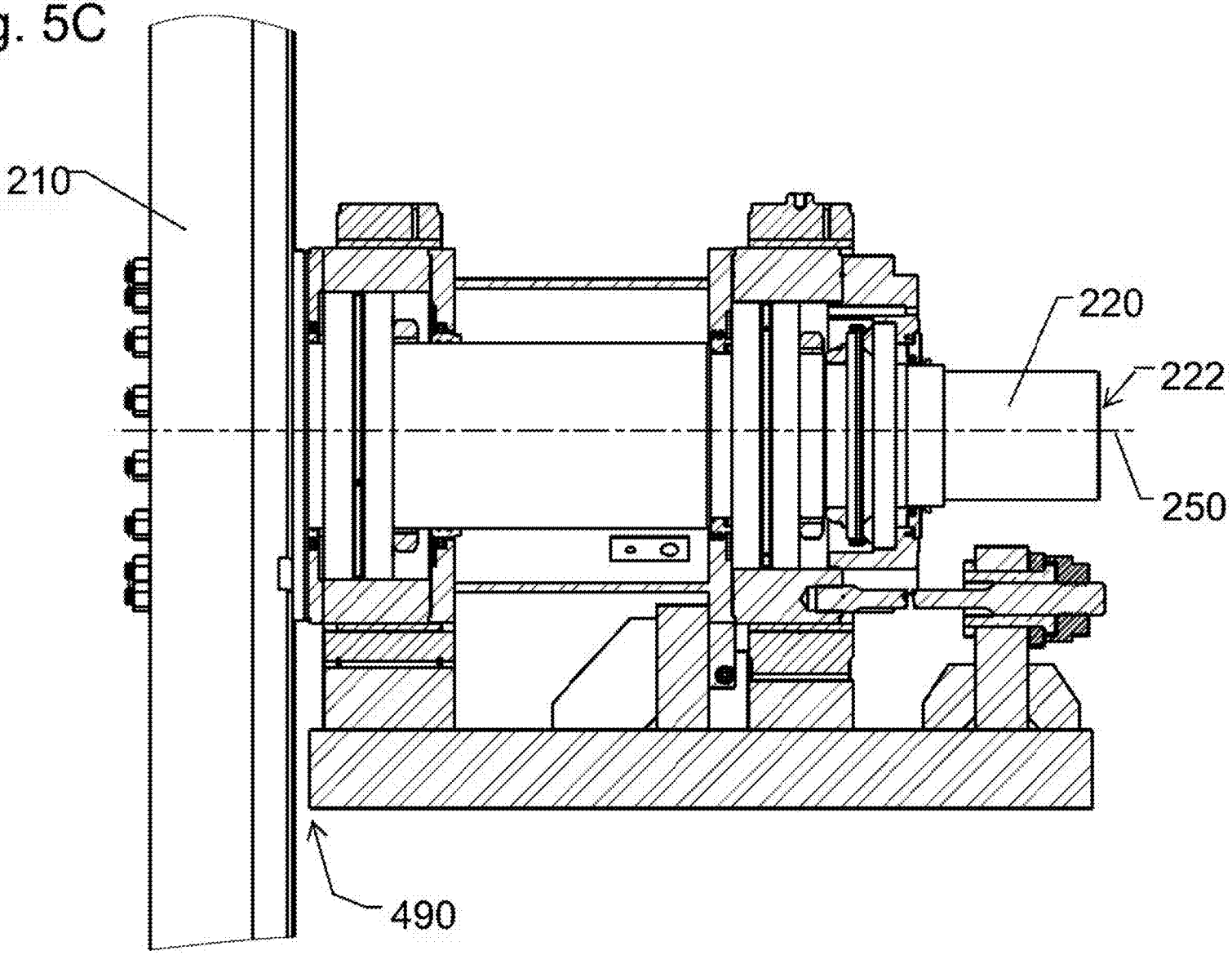

FIGS. 5A-5C are diagrams that illustrate views of a chipper disc recoil locking mechanism. Referring to FIG. 5A, a chipper disc recoil locking mechanism is shown. As shown, a spring loaded pin 560, that is preferably made from metal, and being attached to a compressed spring, is shown in an un-extended (compressed) position, while pressing against and applying a force to a wall 562.

The force is directed perpendicular to the axis of rotation 250 and if the shaft is oriented in a horizontal direction, as shown here, the force being generally parallel to a vertical plane of the surface of the earth. The wall 562 is fixedly attached to and moves axially with, the chipper disc 210 and the shaft 220. The wall 562 includes a cavity 564 that is dimensioned to receive the pin 560. The force applied to the wall 562 via the pin 560 is being generated from the compressed spring which is attached to the pin 560.

Alternatively, a wedge or other type of mechanical device, employing for example, a mechanical latching mechanism, that arrests axial movement of the shaft 210 and of the chipper disc 220, like the mechanical pin and cavity mechanism that is described here, could alternatively be employed to arrest the axial position of the chipper disc 210 and of the shaft 220.

Referring to FIG. 5B, as a result of a chipper disc recoil action (from the "chipping metal" event), the shaft 220 and the chipper disc 210 and the wall 562 recoil and axially displace (move forward) along the axis of rotation 250 and in a direction away from the bed knife 290 (See FIGS. 2A-2B). From the viewing perspective of FIGS. 5A-B, the direction of recoil movement is generally from the left hand side and to the right hand side.

Another mechanism, employing a movement of a pin, wedge or other latching mechanical device can be applied to further limit axial movement of the chipper disc to within a limited distance away from a stationary bed knife in response to breakage of said adjusting screw.

As a result, the wall 562 moves axially forward along with the shaft 220 and the chipper disc 210, and the cavity 564 of the wall 562 aligns with the pin 560, causing the spring loaded pin to extend into the cavity 564, causing the axial position of the shaft 210, disc chipper 220 and wall 564 to lock in place, while the pin 560 remains in the cavity 564. The pin 560 acts as a latching mechanism. Removal of the pin 560 from the cavity 564 unlocks the axial position of the shaft 210, disc chipper 220 and the wall 562 thus permitting the disc to be returned to a position of operation as set by a new adjusting screw 470 which replaces the prior broken adjusting screw 470.

FIG. 5C illustrates the chipper disc 210 in a recoiled and locked position from the viewing perspective of FIG. 2B. From the viewing perspective of FIGS. 5C and 2B, the direction of chipper disc recoil movement is generally from the right hand side and to the left hand side. An opposite side view of the chipper disc recoil gap 490 of FIG. 4C, is shown here in FIG. 5C.

FIG. 6 illustrates a viewing perspective of a wood chipping system similar to that of FIG. 1, instead including two bearing assemblies that are each located on opposite sides of the chipper disc 110. As shown, bearing assembly 170*a* is located on a left hand side of the chipper disc 110, and bearing assembly 170*b* is located on a right hand side of the chipper disc 110.

Figure 7A:
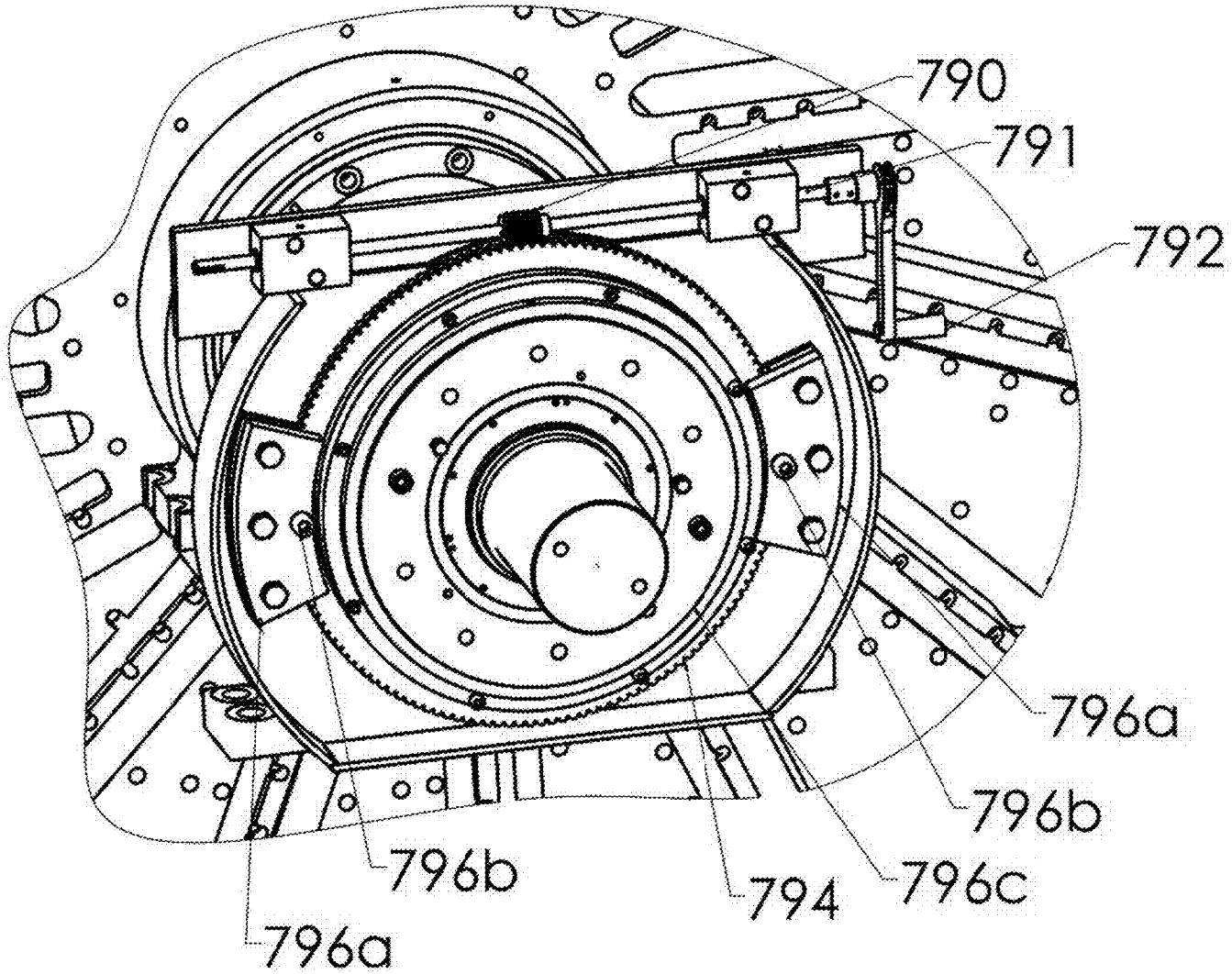
FIGS. 7A-7C illustrate a first alternative embodiment of an axial adjustment mechanism for the rotating chipper disc and shaft.

FIG. 7A illustrates a horizontal perspective view of a first alternative embodiment of an axial adjustment mechanism for the rotating chipper disc 210 and shaft 220, in accordance with the invention. In this embodiment, the axial adjustment mechanism includes components that are disposed at locations surrounding the center axis 250 of the chipper shaft 220.

Within this embodiment, there is a worm gear 790 that is attached to a crank shaft 791 and crank 792. The worm gear 790 is threadedly engaged to a bull gear 794 in a manner so that rotation of the worm gear 790 around an axis that is oriented transverse to the chipper shaft 220, causes rotation of the bull gear 794 around the axis 250 of the chipper shaft 220. The bull gear 794 is configured to include a cavity within a center portion of its structure, like that of the structure of a donut, which enables the bull gear 794 to be disposed at a location surrounding the shaft 220.

The bull gear 794 is also threadedly engaged to a cartridge (not shown here) that is disposed around the chipper shaft 220 and disposed within the cavity of the bull gear 794. The bull gear 794 includes an inner diameter threaded surface that faces the cavity of the bull gear 794 and that faces an outside outer diameter threaded surface of the cartridge. This internal threading of the bull gear 794 engages threading along the outside surface of the cartridge so that rotation of the bull gear 794 causes rotation to the threading of the bull gear 794 and causes movement of the cartridge in an axial direction.

The cartridge surrounds the chipper shaft 220 and it further houses a roller bearing assembly that is physically engaged to the shaft 220. The cartridge is configured so that when the cartridge moves in an axial direction with respect to a long dimension of the shaft 220, the shaft 220 moves with the cartridge towards that same axial direction. Hence, axial movement of the cartridge causes axial movement of the shaft 220, and rotational movement of the bull gear 794 causes axial movement of the cartridge and therefore also axial movement of the shaft 220.

Components of this embodiment further include a bull gear limit bracket 796*a*, also referred to herein as a limit bracket 796*a*, a bull gear pinching screw 796*b*, also referred to herein as a pinching screw 796*b*, and a bull gear locking nut 796*c*, also referred to herein as a locking nut 796*c*. The limit bracket 796*a* is designed to prevent the bull gear 794 from moving in an axial direction, regardless of whether the bull gear 794 is rotating. The pinching screw 796*b* is designed to arrest rotation of the bull gear 794 once a desired axial position of shaft 220 has been set. The locking nut 796*c* performs the same function as the pinching screw 796*b*.

Figure 7B:
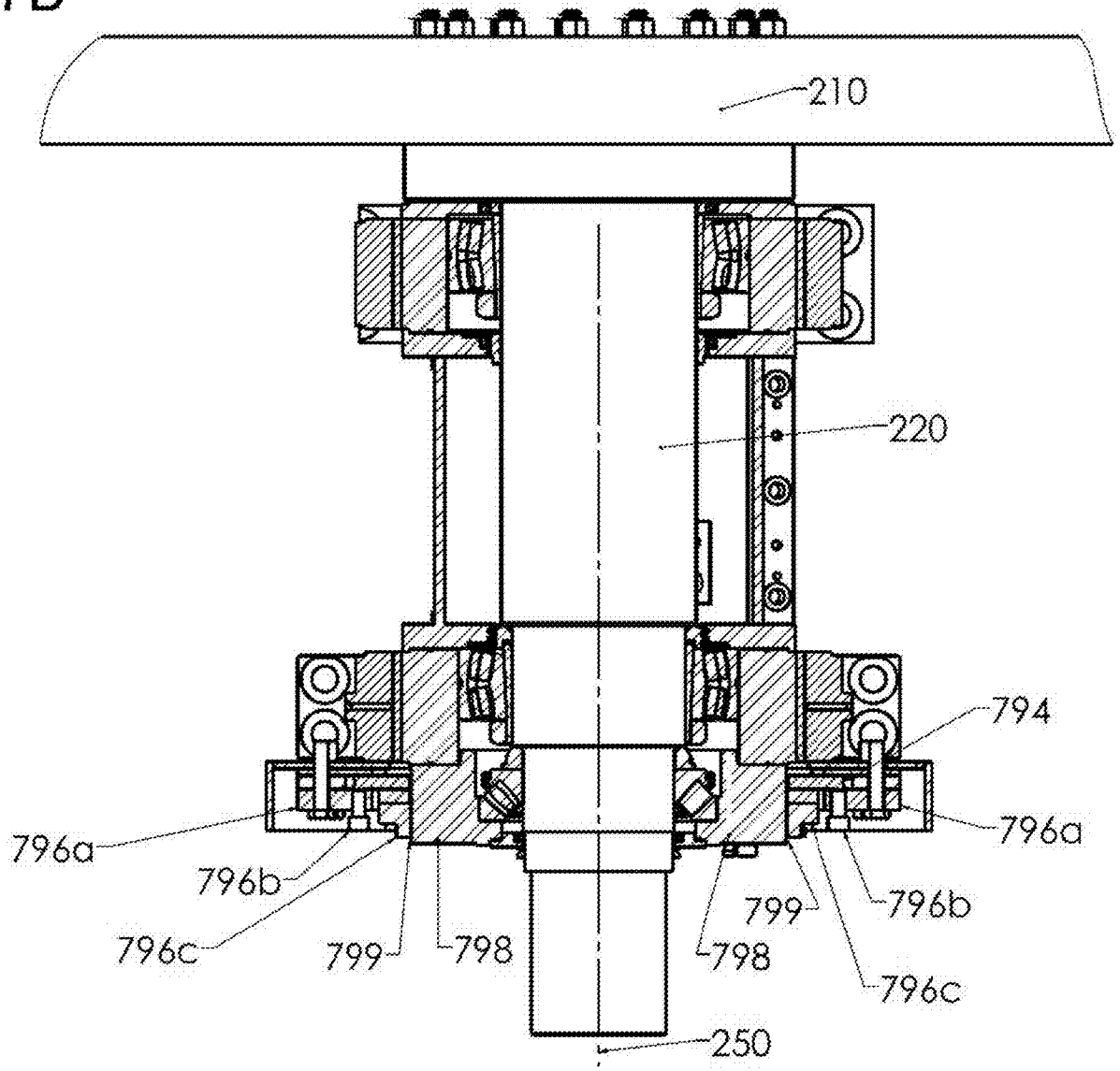

FIG. 7B illustrates a top-down cross-sectional view of the first alternative embodiment of FIG. 7A. As shown, the bull gear 794 is threadedly engaged to the cartridge 798 via physical engagement of threads at location 799 between the threaded surface of the bull gear 794 and the threaded surface of the cartridge 798.

Figure 7C:
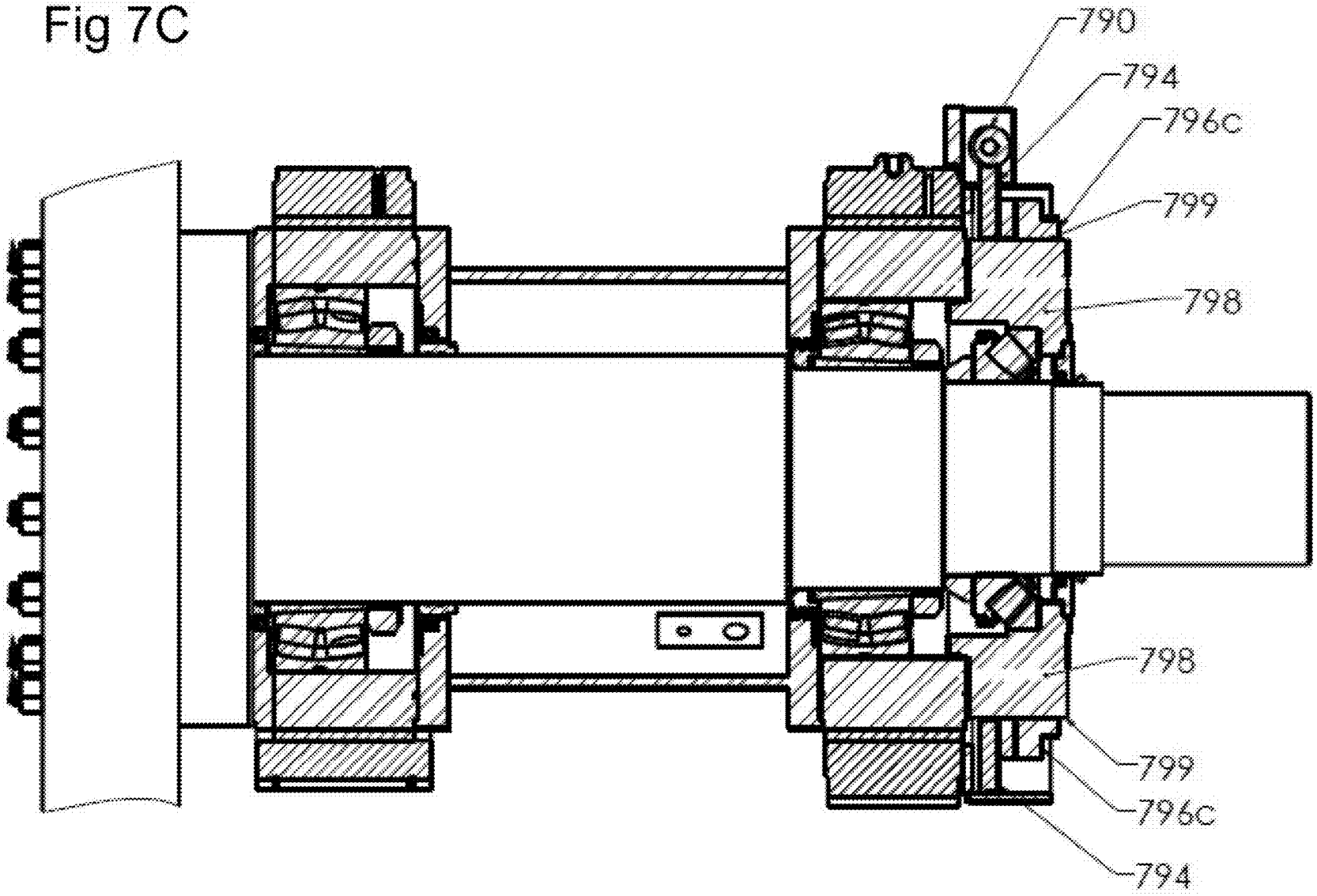

FIG. 7C illustrates a side cross-sectional view of the first alternative embodiment of FIGS. 7A-7B. As shown, the bull gear 794 is threadedly engaged to the cartridge 798 via physical thread engagement at location 799 between the internally threaded surface of the bull gear 794 and the externally threaded surface of the cartridge 798.

Figure 8A:
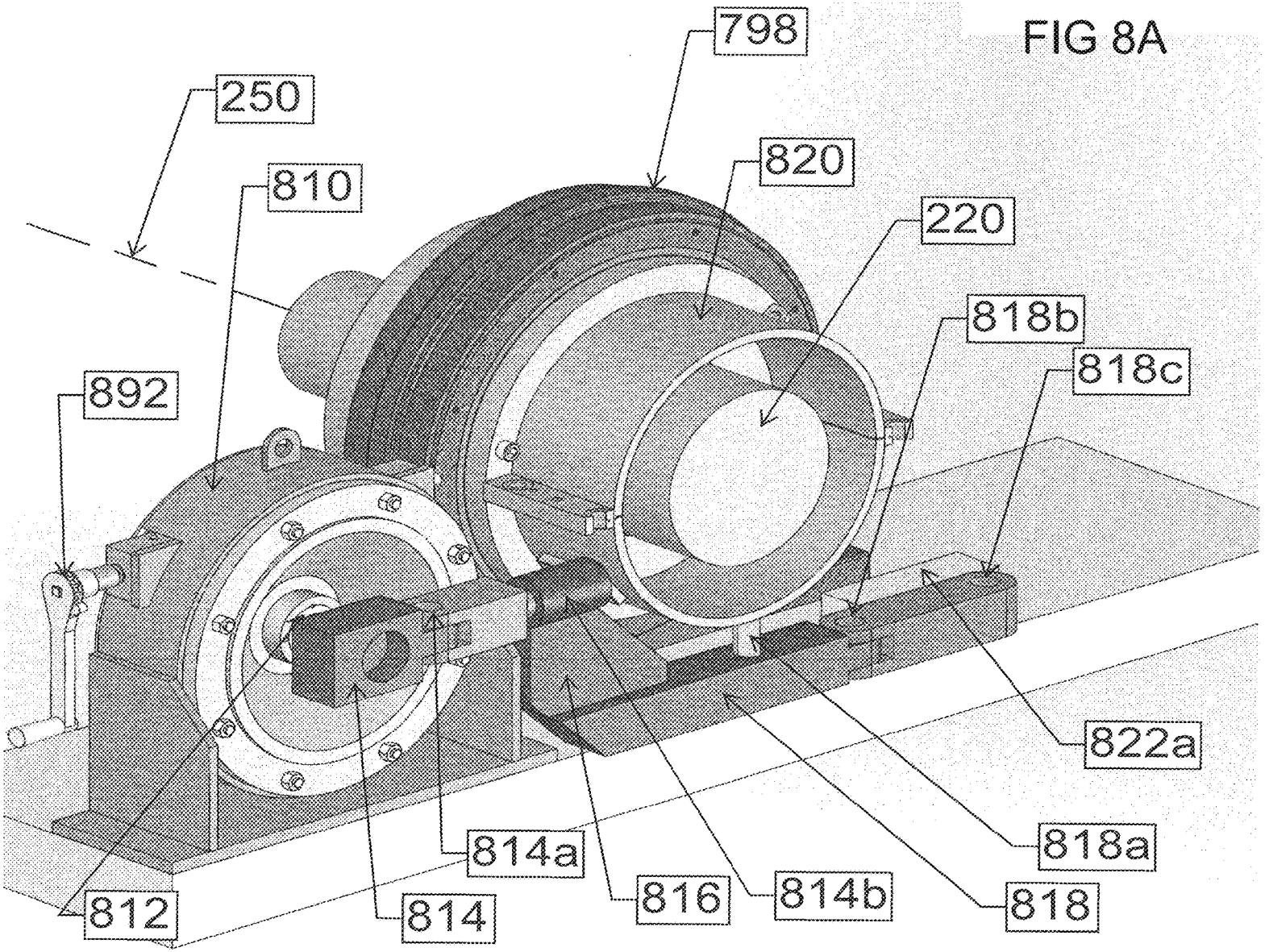
FIGS. 8A-8C illustrate a second alternative embodiment of an axial adjustment mechanism for the rotating chipper disc and shaft.

FIG. 8A illustrates a perspective cross-sectional view of a second alternative embodiment of an axial adjustment mechanism for the rotating chipper disc 210 and shaft 220, in accordance with the invention. In this embodiment, the axial adjustment mechanism includes components that are disposed at locations alongside of the chipper shaft 220.

Within this embodiment, there is a worm gear (not shown here) that is enclosed within an adjusting gear housing 810 and that is attached to a crank shaft 892. The worm gear 890 is threadedly engaged to an adjusting gear 894 that is also enclosed within housing 810, and is engaged in a manner so that rotation of the crank shaft 892 causes rotation of the worm gear 890, which causes rotation of the adjusting gear 894. The adjusting gear 894 functions similar to the bull gear 794 that is shown in FIGS. 7A-7C.

Like the bull gear 794 of FIG. 7A, the adjusting gear is configured to include a cavity within a center portion of its structure, and is shaped like that of the structure of a donut. However, unlike the bull gear 794, the adjusting gear surrounds a thrust screw 812 instead of surrounding the chipper shaft 220 and surrounding a cartridge 798, and rotation of the adjusting gear causes axial movement of the thrust screw 812 in a direction that is parallel to a long dimension of the thrust screw 812 and parallel to the long dimension of the chipper shaft 220 and parallel to the axis 250 of the chipper shaft 220.

A distal end of the thrust screw 812 is attached to an upper thrust connection arm 814. The upper thrust connection arm 814 has a long dimension that is substantially perpendicular to a long dimension of the thrust screw 814 and that is substantially perpendicular to the axis 250 of the chipper shaft 220.

The upper thrust connection arm 814 includes a linkage pin 814*a* and a sliding portion 814*b* and is attached to an arm connection component 816. The arm connection component 816 is also connected to a lower thrust connection arm 818. As a result, the upper thrust connection arm 814 is connected to the lower thrust connection arm 818 via the arm connection component 816.

The lower thrust connection arm 818 includes a first linkage pin 818*a* that is connected to a cartridge connection component 820, and includes a second linkage pivot pin 818*b*. The cartridge connection component 820 has a shell like structure that surrounds the chipper shaft 220 and is fixedly attached to at least one cartridge 794 that is physically engaged to the chipper shaft 220.

Movement of the thrust screw 812 towards an axial direction (forward or backward) causes movement of the upper thrust connection arm 814, movement of the arm connection component 816, movement of the lower thrust connection arm 818, movement of the linkage pin 818*a*, movement of the cartridge connection component 820, movement of the cartridge 798 and movement of the chipper shaft 220 in the same axial direction.

Note that there is slight "wheel barrel" effect associated with the above described movement between the thrust screw 812 and the chipper shaft 220. When the thrust screw 812 is moving forward (toward the viewer of FIG. 8A), the chipper shaft 220 does not move exactly synchronously with the thrust screw 812, meaning that forward movement of the thrust screw 812 will be slightly ahead and forward of the movement of the shaft 220.

Cartridges that are in physical contact with the chipper shaft 220, including cartridge 798, are physically attached to a floor below the chipper shaft 220, and are positioned and designed to constrain movement of the chipper shaft along a straight path in a forward or backward axial direction that is co-axial with that of the rotational axis 250 of the chipper shaft 220.

As a result, any "wheel barrel" effect between the movement of the thrust screw 812 and the resulting movement chipper shaft 220 will not cause the shaft 220 to move along a path that is outside or away from a path defined by the rotational axis 250 of the chipper shaft 220.

Figure 8B:
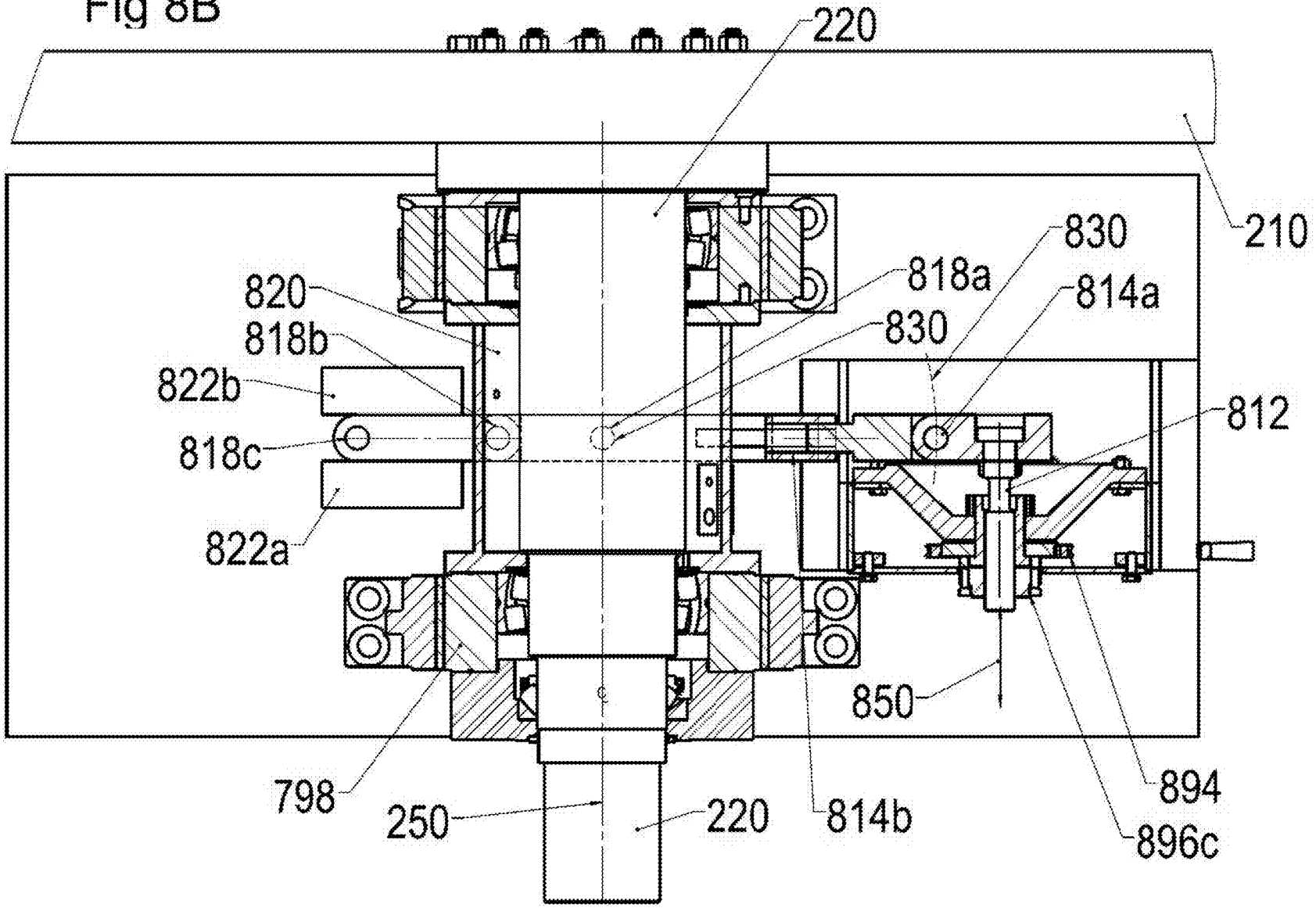

FIG. 8B illustrates a top-down view of the embodiment of FIG. 8A. As shown, an adjusting gear 894 is threadedly engaged to the thrust screw 812. Rotation of the adjusting gear 894 causes the thrust screw 812 to move axially, forward or backward, along a rotational axis of the thrust screw 850. Axial movement 850 of the thrust screw 812 towards an axial direction causes movement of the upper thrust connection arm 814, linkage pin 814*a* and movement of the arm connection component 816 (See FIG. 8A), movement of the lower thrust connection arm 818 (See FIG. 8A), movement of the linkage pin 818*a*, movement of the cartridge connection component 820, movement of the cartridge 798 and movement of the chipper shaft 220 in the same axial direction.

Notice that the "wheel barrel" effect of the movement associated with the thrust screw 812 and the upper thrust connection arm 814 is shown as a slight arc 830. However, the shaft 220 moves in a straight line along the axis of rotation 250 in response to axial movement of the thrust screw 812 and the upper thrust connection arm 814.

Notice that linkage pin 818*a* is designed to permit rotation and will in fact rotate slightly when the lower thrust connection arm 818 is moved forward or backward linearly. Linkage pin 818*b* is constrained to only be able to move perpendicular to the axis of rotation 250 via surrounding barriers 822*a*-822*b*.

Figure 8C:
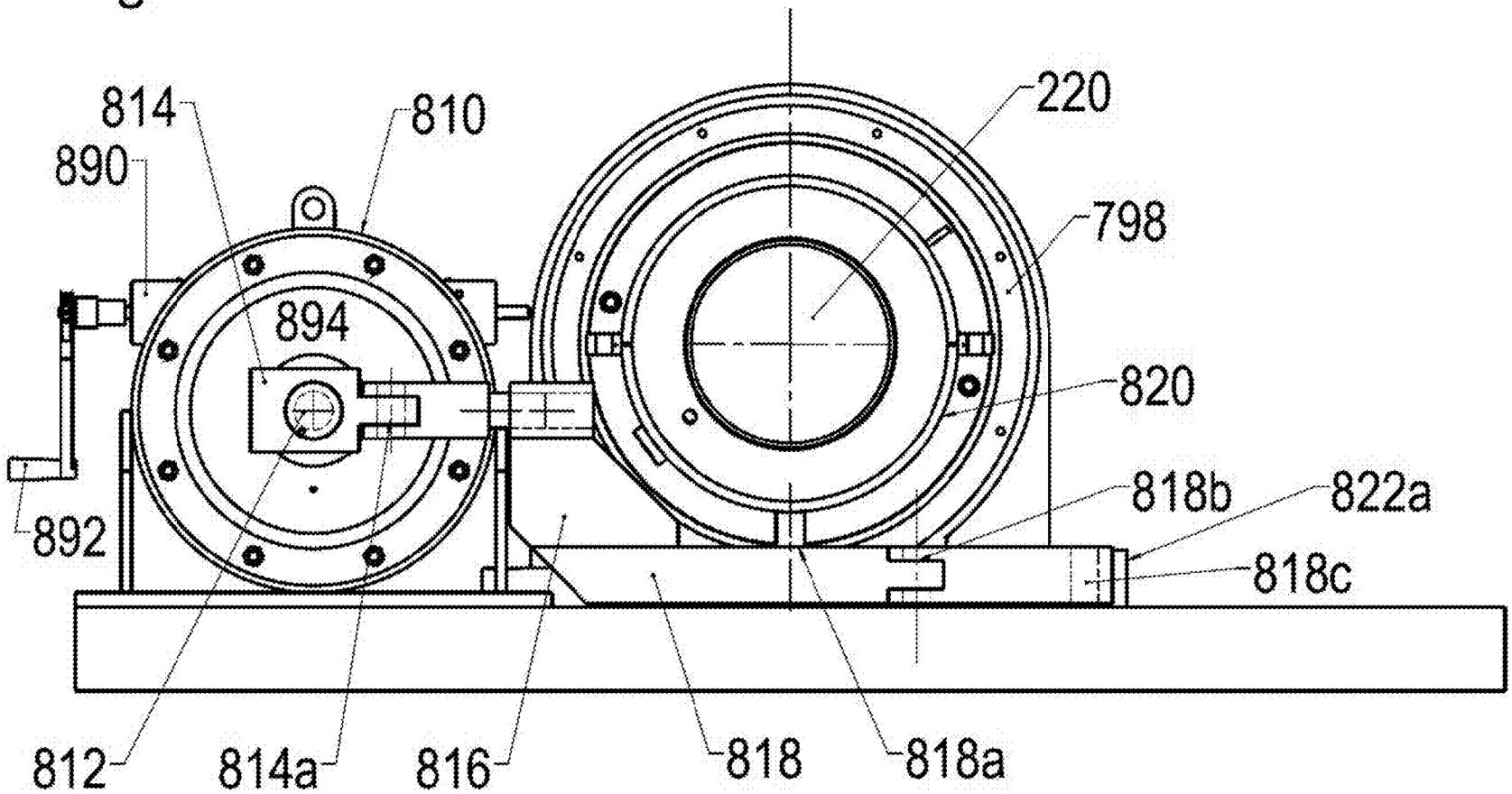

FIG. 8C illustrates a horizontal cross-sectional view of the embodiments of FIGS. 8A-8B. As shown, crank shaft 892 is designed to turn a worm gear 890, which rotates an adjusting gear 894 and causes movement to a thrust screw 812 in an axial direction. Axial movement of the thrust screw 812 causes movement of an upper thrust connection arm 814 in the same axial direction. Movement of the upper thrust connection arm 814 causes movement of the arm connection component 816 and causes movement of the lower thrust connection arm and causes axial (250) movement of the linkage pin 818*a* and causes movement of the cartridge connection component 820, causes movement of the cartridge 798 and causes movement of the chipper shaft 220 in the same axial direction.

This written description uses example embodiments to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

PARTS LIST

100 wood chipping system (of FIG. 1)
110 chipper disc (of FIG. 1)
120 shaft (of FIG. 1)
122 end face of end of shaft 120
130 nominally radial cutting knives
140 wood input spout
150 wood log
160 structural mount
170 bearing assembly
190 bed knife (of FIG. 1)
200 wood chipping system (of FIGS. 2A-2B)
210 chipper disc (of FIGS. 2A-2B)
220 shaft (of FIGS. 2A-2B)
222 end face of the end of shaft 220
230 rolling element bearing assembly, radial roller bearing assembly
232 inner race of 230
234 bearing rollers of 230
236 outer race
238 bearing roller retention mechanism, wall
250 axis of rotation
290 bed knife (of FIGS. 2A-2B, 4A-4C)
350 retaining axis
352 center line 352 of the bearing retention mechanism 238
400 wood chipping system (of FIGS. 4A-4C)
430 radial roller bearing assemblies
432 inner race of 430
434 bearing rollers, roller bearings
436 outer race of 430
440 thrust bearing
444 bearing rollers of 440
462 cartridge, outer enclosure of roller bearing assembly
470 adjusting screw
472 adjusting nut
474 rear carrier sleeve (In some cases is rear end of cartridge, 462)
476 locking nut
477 slide bearing—housing to cartridge
478 neck of the adjusting screw 470
480 groove
481 cartridge support housing
482 axial gap
488 location of breakage gap in adjusting screw after breakage
490 chipper disc recoil gap
560 spring loaded pin
562 wall
564 cavity of the wall 562
790 worm gear
792 crank shaft
794 bull gear
796*a* bull gear limit bracket
796*b* bull gear pinching screw
796*c* bull gear locking nut
798 cartridge
799 threads engaged between bull gear and cartridge
810 adjusting gear housing
812 thrust screw
814 upper thrust connection arm
814*a* linkage pin
814*b* sliding portion of upper thrust connection arm
816 arm connection component
818 lower thrust connection arm
818*a* linkage pin
818*b* linkage pin

890 worm gear
892 crank shaft

The invention claimed is:

1. A wood chipping apparatus, including a mechanism for adjusting and fixing an operational set point, being an axial position of an axially displaceable shaft and rotary chipper disc combination, comprising:

an axially displaceable shaft having a long dimension and a first end and a second end and a middle portion, said first end or middle portion being attached to a rotary chipper disc, said shaft and chipper disc being configured to rotate together around an axis of rotation;

at least two or more bearing assemblies, said bearing assemblies being configured to provide physical support to a position of said shaft; and at least one bearing assembly of said bearing assemblies being further configured to apply an axial force to said shaft, in either one or both of opposing axial directions being parallel to said long dimension of said shaft, in response to a force that is applied to said at least one bearing assembly, via an axial adjustment mechanism;

said axial adjustment mechanism, including a rotating element that when caused to rotate, causes transfer of a sufficient amount of force to cause axial movement of said shaft; and wherein said axial adjustment mechanism is configured to operate without requiring attachment to nor obstruction of, an end face of said second end of said shaft.

2. The apparatus of claim 1, wherein said rotating element, when caused to rotate, transfers a force directly or indirectly to said at least one bearing assembly, and where said force is directed parallel to said axis of rotation of said shaft.

3. The apparatus of claim 2, wherein said rotating element is an adjusting nut, that causes axial movement of an adjusting screw that is configured to apply an axial directed force to said shaft via a carrier sleeve that is attached to said at least one bearing assembly.

4. The apparatus of claim 3, wherein said at least one bearing assembly is attached to said shaft in such a manner so as to not permit axial movement of said shaft relative to said bearing assembly of no more than permitted by the bearing's internal axial clearances.

5. The apparatus of claim 3 wherein said adjusting screw is designed to break apart when a first tensile axial force that exceeds a threshold value is applied to said shaft.

6. The apparatus of claim 3 wherein movement of a pin, wedge or other latching mechanical device is applied to hold an axial position of said chipper disc away from a stationary bed knife in one axial direction in response to breakage of said adjusting screw.

7. The apparatus of claim 2, wherein said rotating element is a gear that directly or indirectly causes axial movement of a cartridge and of said at least one bearing assembly attached to said cartridge.

8. The apparatus of claim 1 including at least one thrust bearing to provide axial support for said shaft, whether or not said shaft when in operation is tilted away from a horizontal position.

9. The apparatus of claim 1 wherein said at least one bearing assembly includes some non-rotating elements and wherein said non-rotating elements are not required to be loosened to permit an axial force to be applied to said shaft by said axial adjustment mechanism.

10. The apparatus of claim 1 wherein said bearing assembly provides continuous radial support including during an adjustment of an axial position of said shaft.

11. The apparatus of claim 3 wherein said adjusting screw, being a rotating element, is not rotationally fixed to the carrier sleeve so that it can instead be turned inside of a fixed threaded nut in order to obtain movement of and to provide axial positioning and support for the shaft and disc assembly.

12. The apparatus of claim 11 wherein once the axial position of the shaft and disc assembly is set, any rotating element is clamped in place with a clamping nut.

13. The apparatus of claim 7 wherein said gear is rotated directly or indirectly via rotation of a crank shaft.

14. The apparatus of claim 3, wherein said at least one bearing assembly is attached to said shaft in such a manner so as to not permit axial movement of said shaft relative to said bearing assembly of no more than 30 thousands of an inch.

15. The apparatus of claim 6 wherein movement of a pin, wedge or other latching mechanical device is applied to further limit an axial movement of said chipper disc to within a limited distance away from a stationary bed knife in response to breakage of said adjusting screw.

16. A method for adjusting and fixing an operational set point of a wood chipping apparatus, being an axial position of an axially displaceable shaft and rotary chipper disc combination, comprising:

providing an axially displaceable shaft having a long dimension and a first end and a second end and a middle portion, said first end or middle portion being attached to a rotary chipper disc, said shaft and chipper disc being configured to rotate together around an axis of rotation;

at least two or more bearing assemblies, said bearing assemblies being configured to provide physical support to a position of said shaft; and providing at least one bearing assembly of said bearing assemblies being further configured to apply an axial force to said shaft, in either one or both of opposing axial directions being parallel to said long dimension of said shaft, in response to a force that is applied to said at least one bearing assembly, via an axial adjustment mechanism; and wherein said axial adjustment mechanism including a rotating element that when caused to rotate, causes transfer of a sufficient amount of force to cause axial movement of said shaft; and wherein said axial adjustment mechanism is configured to operate without requiring attachment to nor obstruction of an end face of said second end of said shaft.

17. A wood chipping system including a mechanism for adjusting and fixing an operational set point, being an axial position of an axially displaceable shaft and rotary chipper disc combination, comprising:

at least two or more bearing assemblies, said bearing assemblies being configured to provide physical support to a position of a shaft; and at least one bearing assembly of said bearing assemblies being further configured to apply an axial force to said shaft, in either one of opposing axial directions being parallel to a long dimension of said shaft, in response to a force that is applied to said at least one bearing assembly, via an axial adjustment mechanism;

said axial adjustment mechanism including a rotating element that when caused to rotate, causes transfer of a sufficient amount of force to cause axial movement of said shaft; and wherein said axial adjustment mechanism is configured to operate without requiring attachment to nor obstruction of an end face of said second end of said shaft.

18. The apparatus of claim 1 wherein said axial adjustment mechanism is further configured to operate without requiring attachment to, nor obstruction of, an end face of said first end of said shaft.

19. The method of claim 16 wherein said axial adjustment mechanism is further configured to operate without requiring attachment to, nor obstruction of, an end face of said first end of said shaft.

20. The system of claim 17 wherein said axial adjustment mechanism is further configured to operate without requiring attachment to, nor obstruction of, an end face of said first end of said shaft.

* * * * *